US005245925A

United States Patent [19]

Switall et al.

[11] Patent Number: 5,245,925

[45] Date of Patent: Sep. 21, 1993

[54] DRY BRUSH CLEANING APPARATUS AND METHOD FOR CLEANING PRINTING PRESS BLANKET CYLINDERS

[75] Inventors: Thomas G. Switall, Kildeer; Martin Kaczmarek, Chicago, both of Ill.

[73] Assignee: Ryco Graphic Manufacturing Inc., Wheeling, Ill.

[21] Appl. No.: 510,943

[22] Filed: Apr. 19, 1990

[51] Int. Cl.[5] ..... B41F 35/00

[52] U.S. Cl. ..... 101/425; 101/423

[58] Field of Search ..... 101/423, 424, 424.1, 101/425; 15/256.52

[56] References Cited

U.S. PATENT DOCUMENTS

| | | | |
|---|---|---|---|
| 359,513 | 3/1887 | Millard | 101/155 |
| 504,465 | 9/1893 | Beater | 101/167 |
| 1,114,893 | 10/1914 | Lerche | 101/216 |
| 2,752,271 | 6/1956 | Walkup et al. | 101/425 |
| 2,792,697 | 5/1957 | Gingold | 65/62 |
| 2,844,123 | 7/1958 | Hayford | 118/637 |
| 3,049,997 | 8/1962 | Grembecki et al. | 101/425 |
| 3,120,805 | 2/1964 | Simon | 101/425 |
| 3,186,019 | 6/1965 | Hattori | 15/179 |
| 3,217,646 | 11/1965 | Sharkey | 101/425 |
| 3,246,931 | 4/1966 | Enchelmaier et al. | 300/2 |
| 3,309,993 | 3/1967 | Grembecki et al. | 101/425 |
| 3,486,448 | 12/1969 | Anderson et al. | 101/425 |
| 3,508,711 | 4/1970 | Switall | 239/562 |
| 3,594,841 | 7/1971 | Kieves | 15/4 |
| 3,604,239 | 9/1971 | Moxon | 101/425 |
| 3,763,778 | 10/1973 | Sills et al. | 101/426 |
| 3,835,779 | 9/1974 | Ross et al. | 101/425 |
| 4,015,307 | 4/1977 | Kossak | 101/425 |
| 4,054,685 | 10/1977 | Giori | 101/425 |
| 4,066,017 | 1/1978 | Garcowski et al. | 101/425 |
| 4,099,287 | 7/1978 | Enchelmaier | 15/182 |
| 4,113,376 | 9/1978 | Rodda | 15/256.52 |
| 4,126,358 | 11/1978 | Enchelmaier | 300/21 |
| 4,389,936 | 6/1983 | Jaffa et al. | 101/123 |
| 4,393,778 | 7/1983 | Kaneko | 101/425 |
| 4,407,038 | 10/1983 | Haase | 15/105 |
| 4,451,139 | 5/1984 | Yanagawa et al. | 15/256.52 |
| 4,537,130 | 8/1985 | Theilacker | 101/425 |
| 4,667,597 | 5/1987 | Wright et al. | 101/425 |
| 4,704,963 | 11/1987 | Nishimura et al. | 101/425 |
| 4,706,320 | 11/1987 | Swift | 15/182 |
| 4,747,348 | 5/1988 | Jeschke et al. | 101/425 |
| 4,757,763 | 7/1988 | MacPhee et al. | 101/425 |
| 4,819,031 | 4/1989 | Thayer et al. | 15/256.52 |
| 4,841,862 | 6/1989 | Seefried | 101/423 |
| 4,875,412 | 10/1989 | Wright et al. | 101/425 |
| 4,972,780 | 11/1990 | Gasparrini | 101/425 |

FOREIGN PATENT DOCUMENTS

| | | | |
|---|---|---|---|
| 3120983 | 4/1982 | Fed. Rep. of Germany . | |
| 1061695 | 3/1967 | United Kingdom . | |
| 2032848 | 5/1980 | United Kingdom | 101/425 |

OTHER PUBLICATIONS

IBM Technical; Disclosure Bulletin, "Force Loaded Cleaning Station", Davidge and Johnson, vol. 16, No. 4, Sep. 1973, pp. 1265-1267.

Xerox Disclosure Journal, "Brush Cleaner-Contoured Air Flow Baffles", Barisme, Lange, Oszczakiewicz, pp. 405-406.

News from Baldwin: Model 1320 Newpaper Blanket Cleaner, Oct. 1987.

Baldwin Dry Brush Technology, Automatic Blanket Cleaner, Model 1320, Oct. 1989.

Presstime article, "Blanket-Cleaning System Uses No Chemicals", Jun. 1985.

*Primary Examiner*—Edgar S. Burr

*Assistant Examiner*—Christopher A. Bennett

*Attorney, Agent, or Firm*—Willian Brinks Olds Hofer Gilson & Lione

[57] ABSTRACT

A dry brush cleaning apparatus and method for cleaning printing press blanket cylinders is disclosed. In one embodiment, the invention comprises a frame spanning the width of the working surface of the blanket cylinder; a plurality of rollers, at least one of which is secured to each end of the frame, the rollers being positioned to straddle the blanket and engage the bearer surfaces of the blanket cylinder, at least one of the rollers being a drive roller; a cleaning brush rotatably mounted on the frame; a drive interconnecting the drive roller and the cleaning brush to cause power developed by frictional engagement of the drive roller and the bearer surface to impart rotation to the cleaning brush; and a mechanism for delaying a cleaning engagement of the cleaning brush with the blanket cylinder until after power generated by frictional engagement of the drive wheel with the bearer surface has caused the cleaning brush to begin rotating.

35 Claims, 12 Drawing Sheets

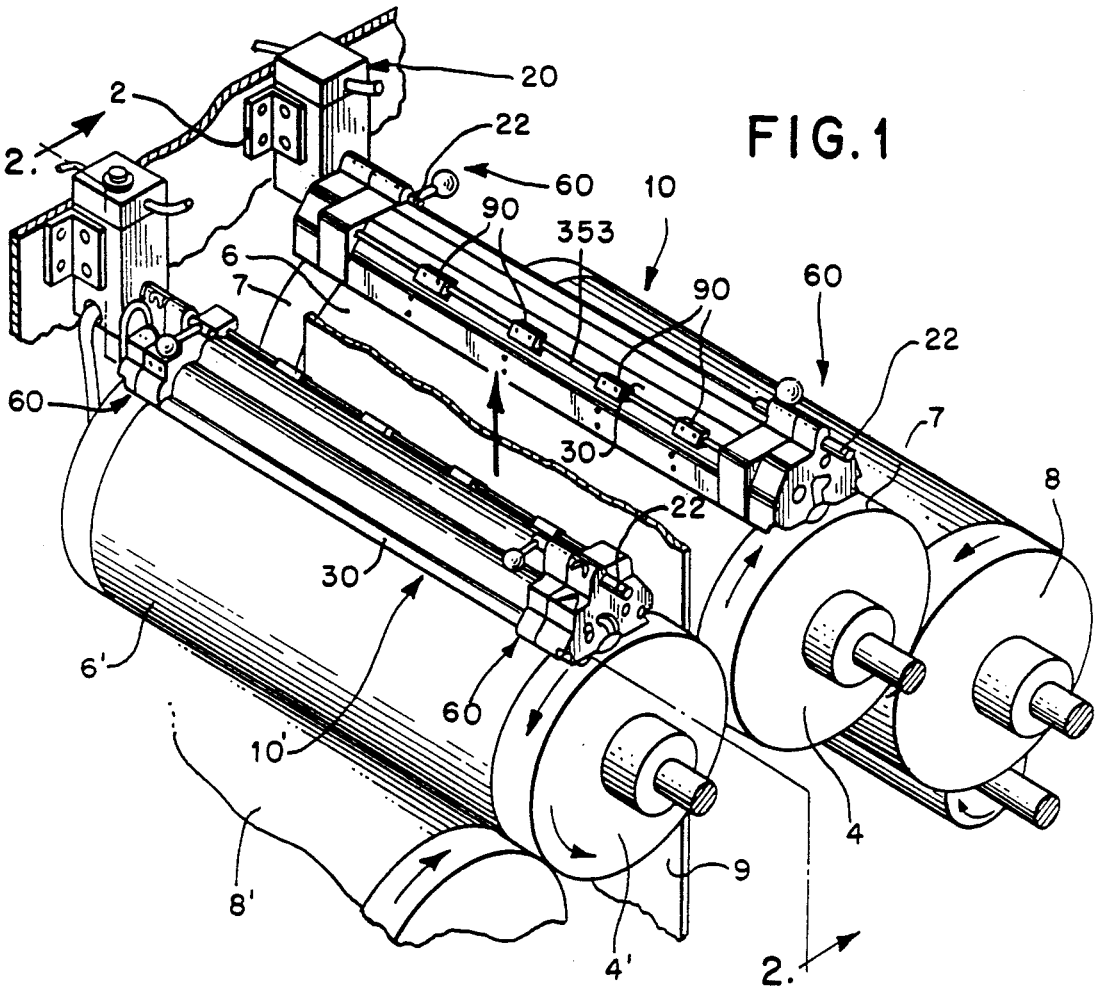
FIG. 1
FIG. 2
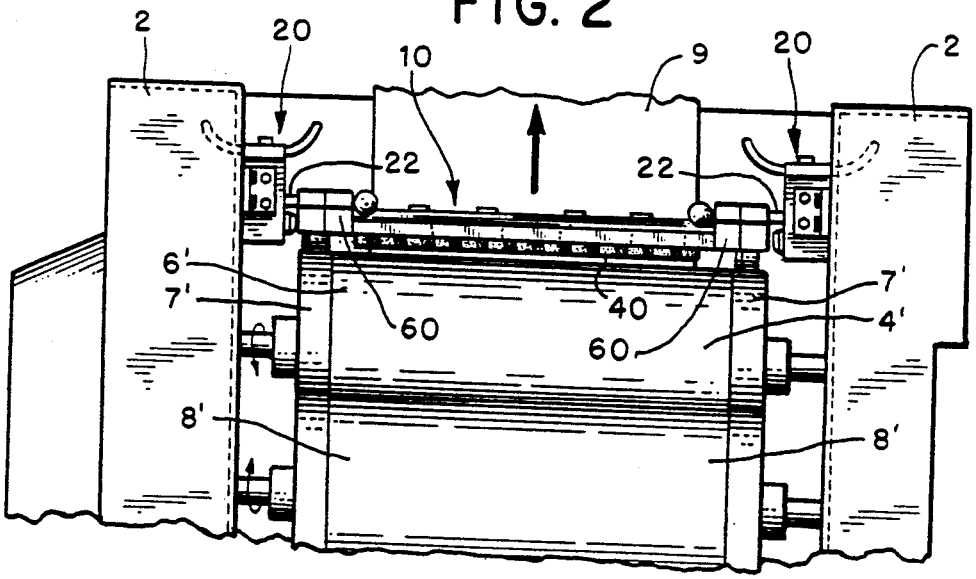

10
22
30
31
32
34
40
42
47
48
50
53
54
55
56
59
60
62
64
66
74
80
90
91
92
93
106
109
201
202
203
342
343
353
377
4.
5.
6
7.
8.
10.

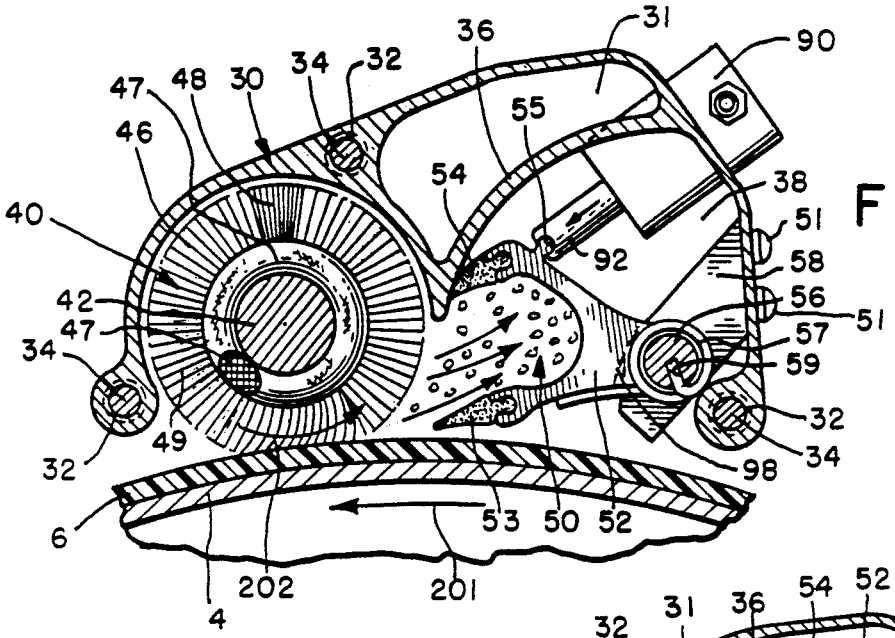
FIG. 5
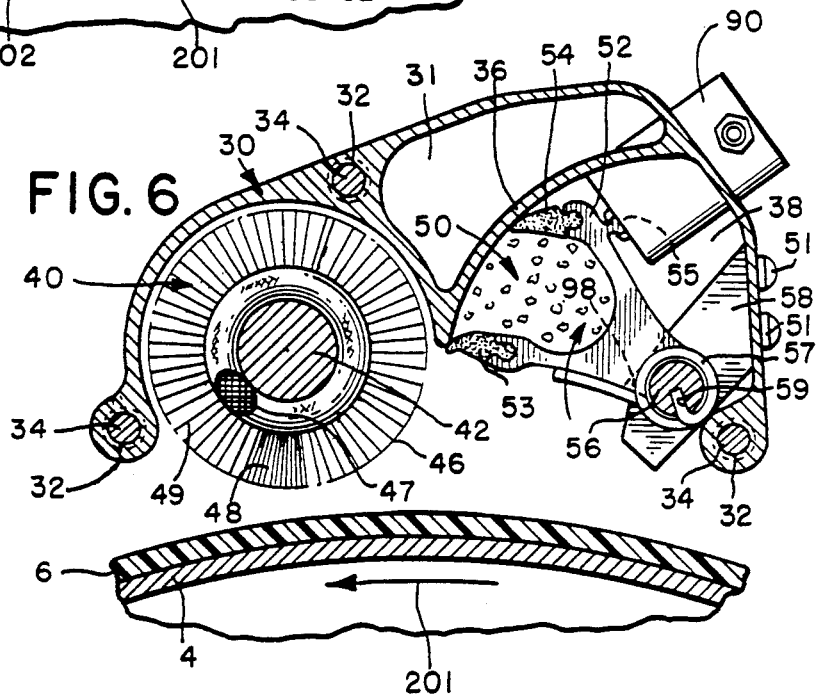
FIG. 6
FIG. 7
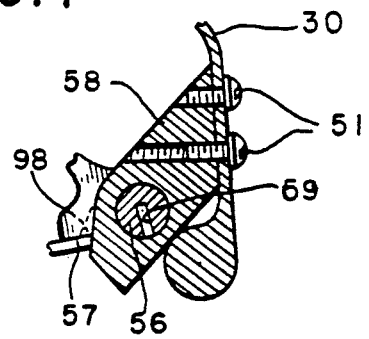

FIG. 8
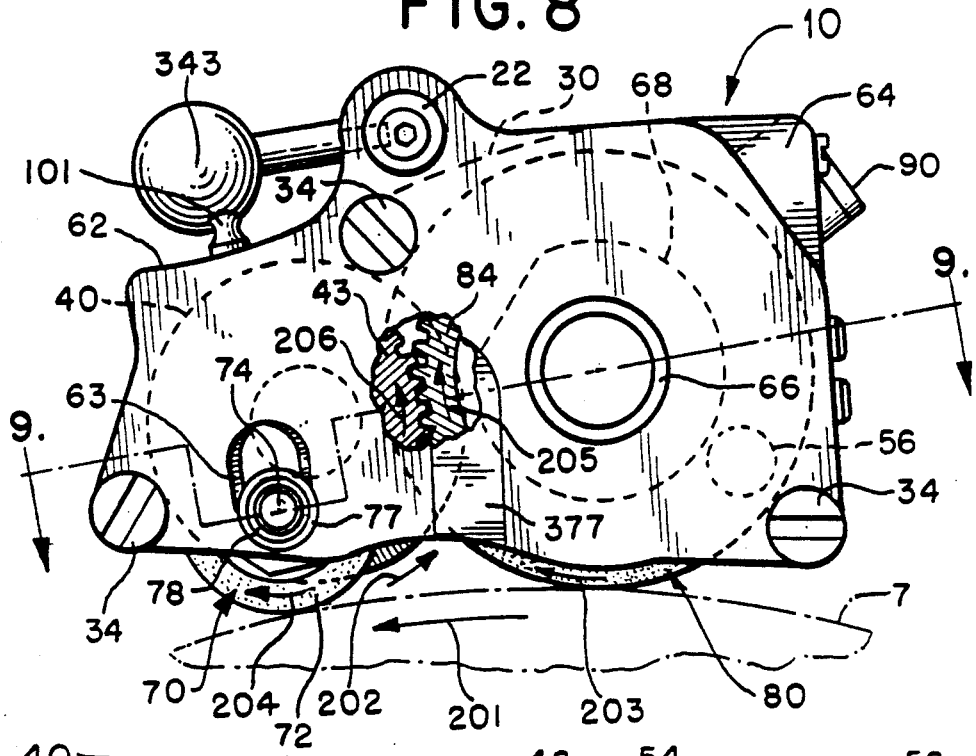
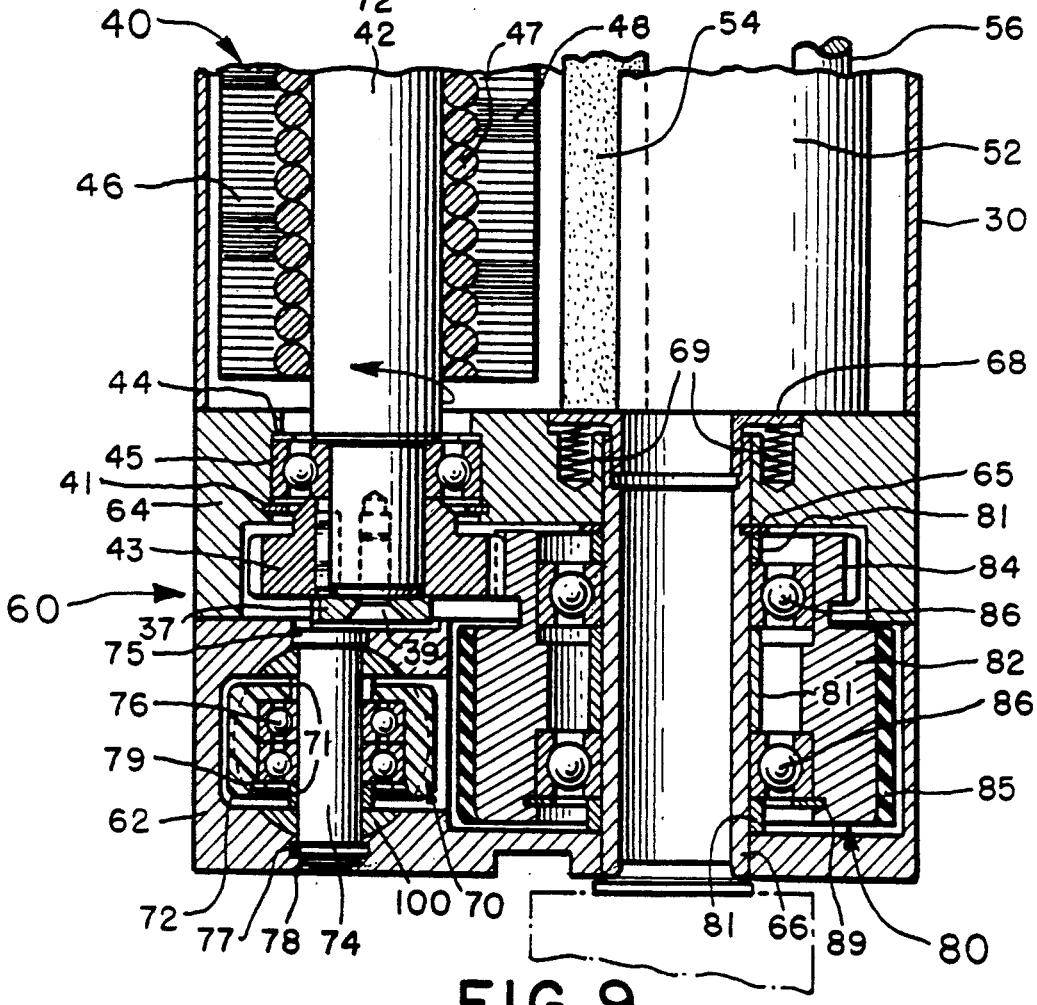
FIG. 9

FIG. 13
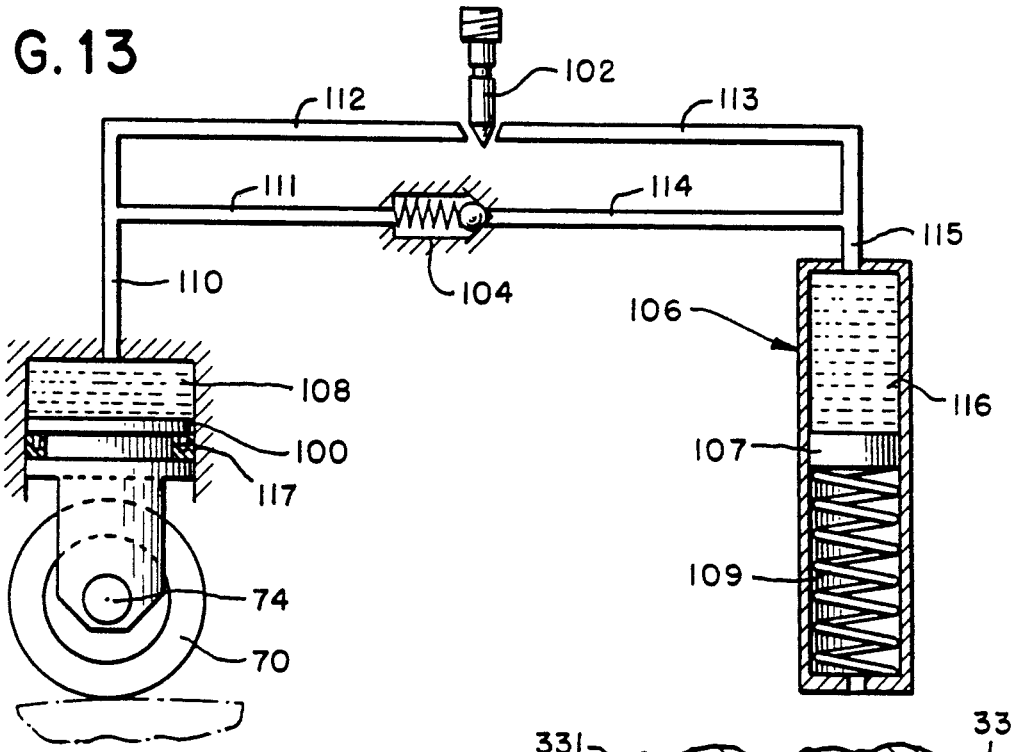
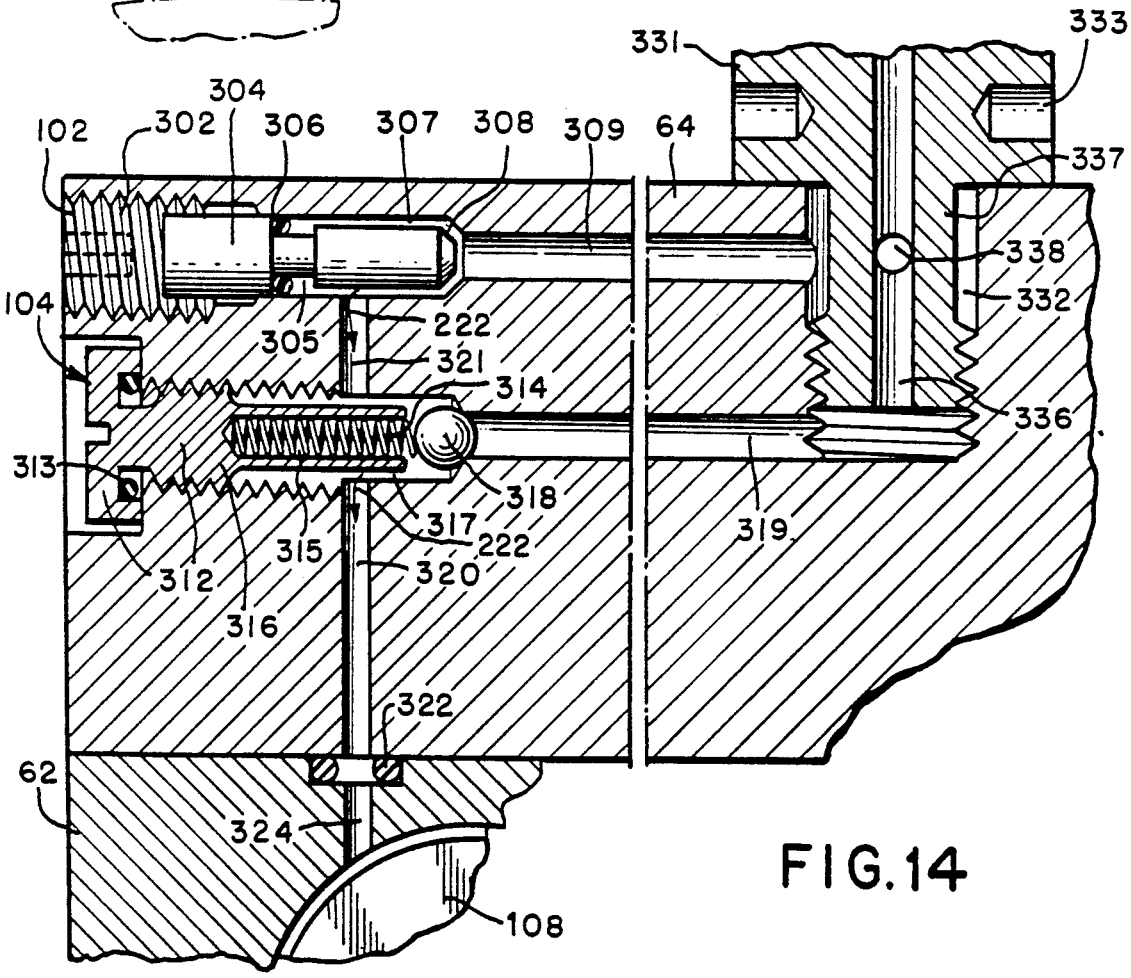
FIG. 14

FIG.18
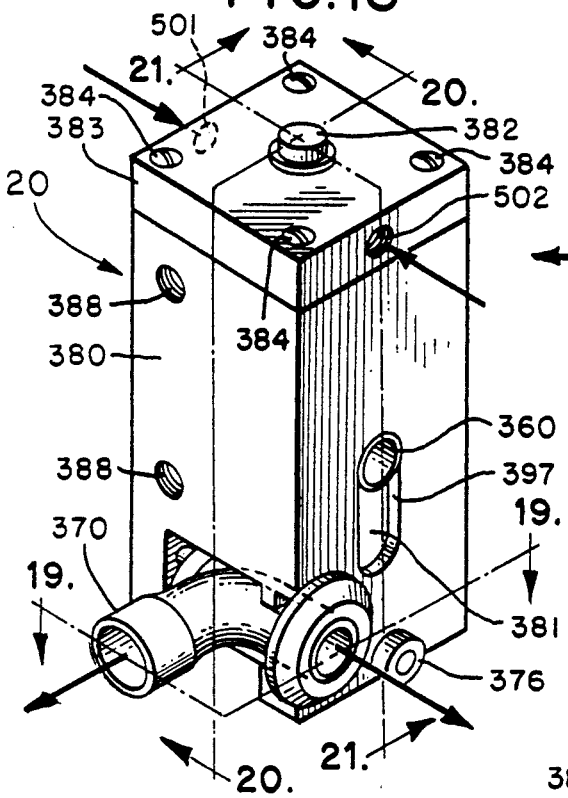
FIG.19
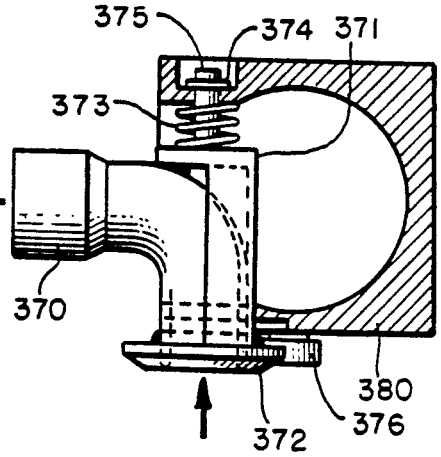
FIG.20
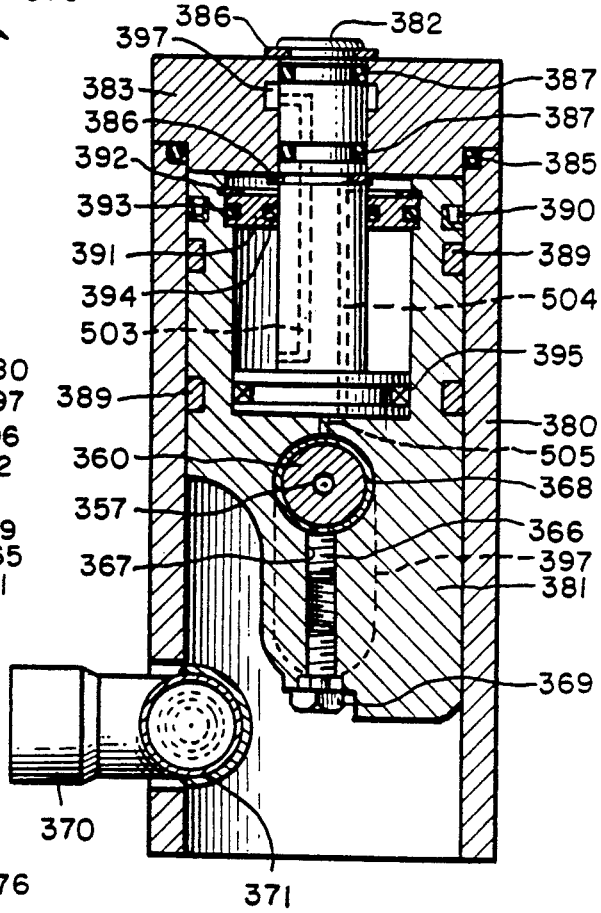
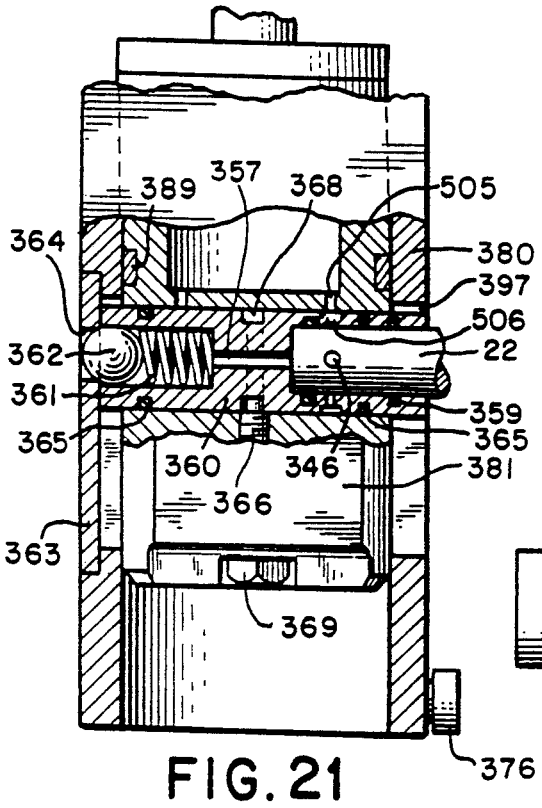
FIG.21

FIG. 23
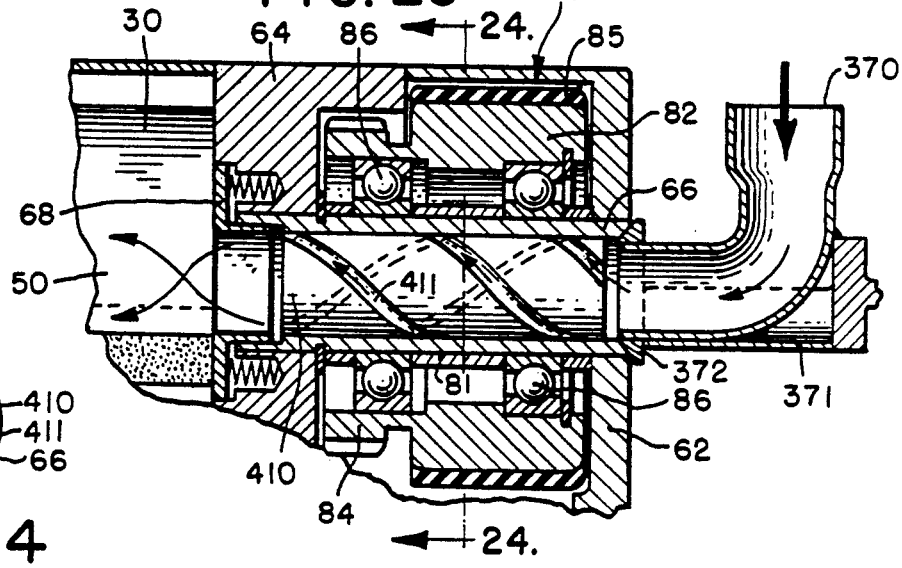
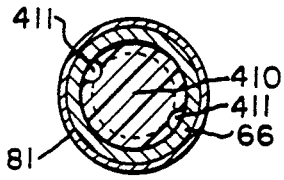
FIG. 24
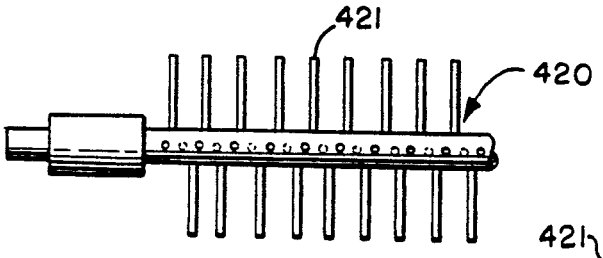
FIG. 26
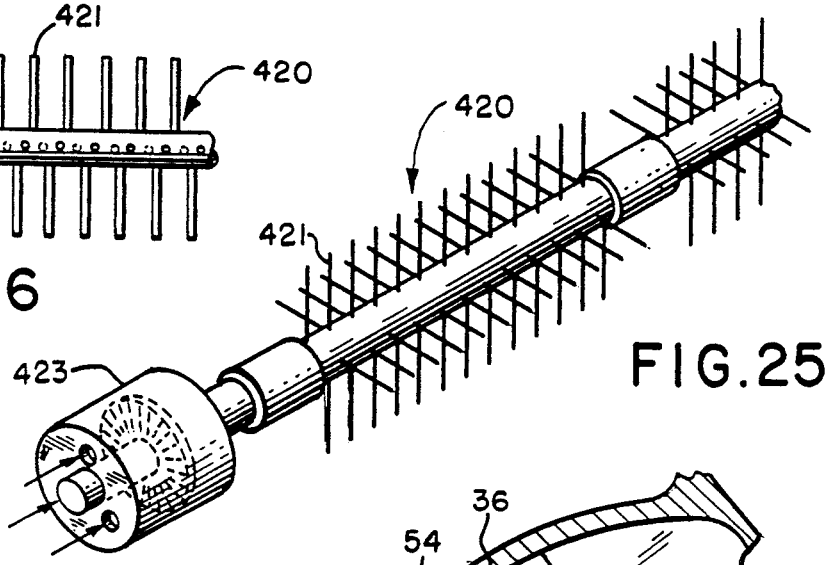
FIG. 25
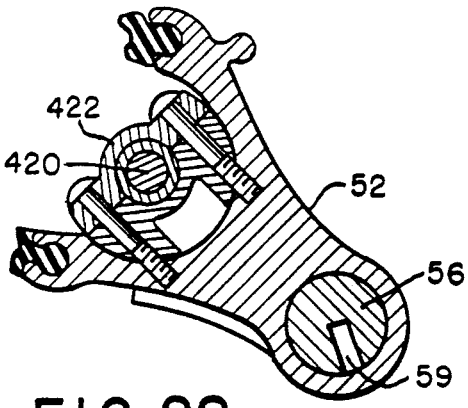
FIG. 28
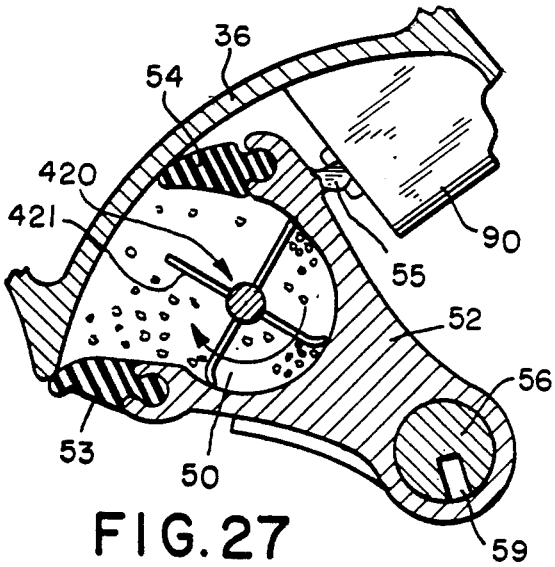
FIG. 27

FIG. 29
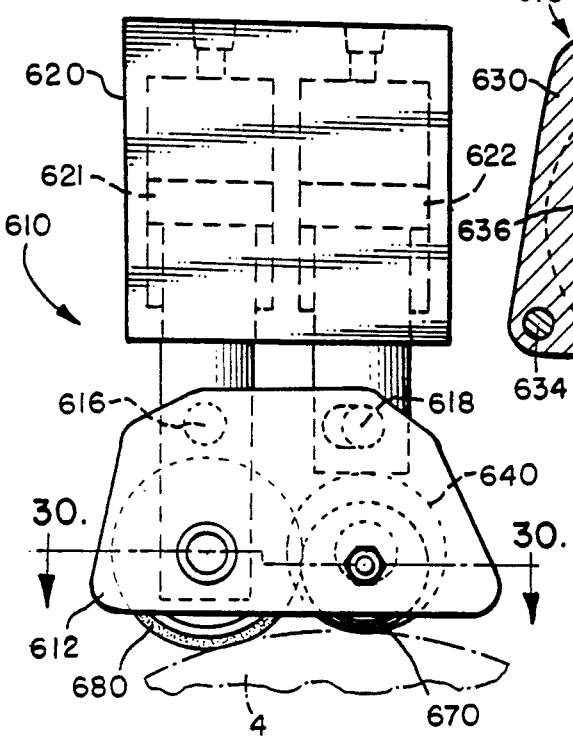
FIG. 31
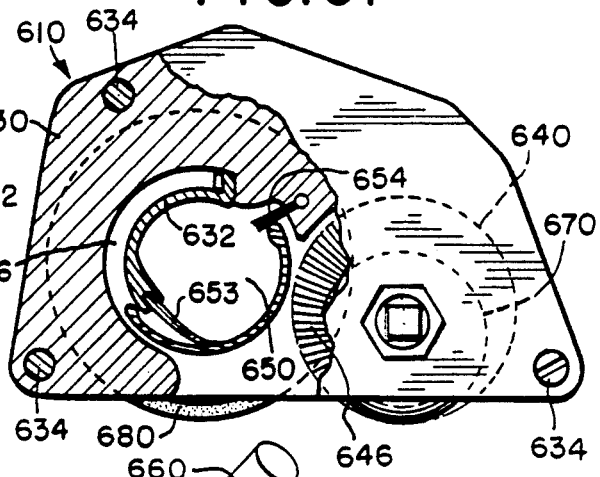
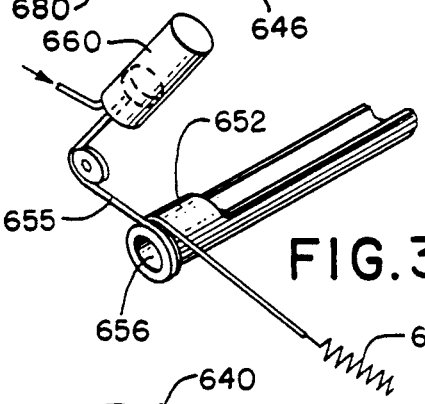
FIG. 32
FIG. 30
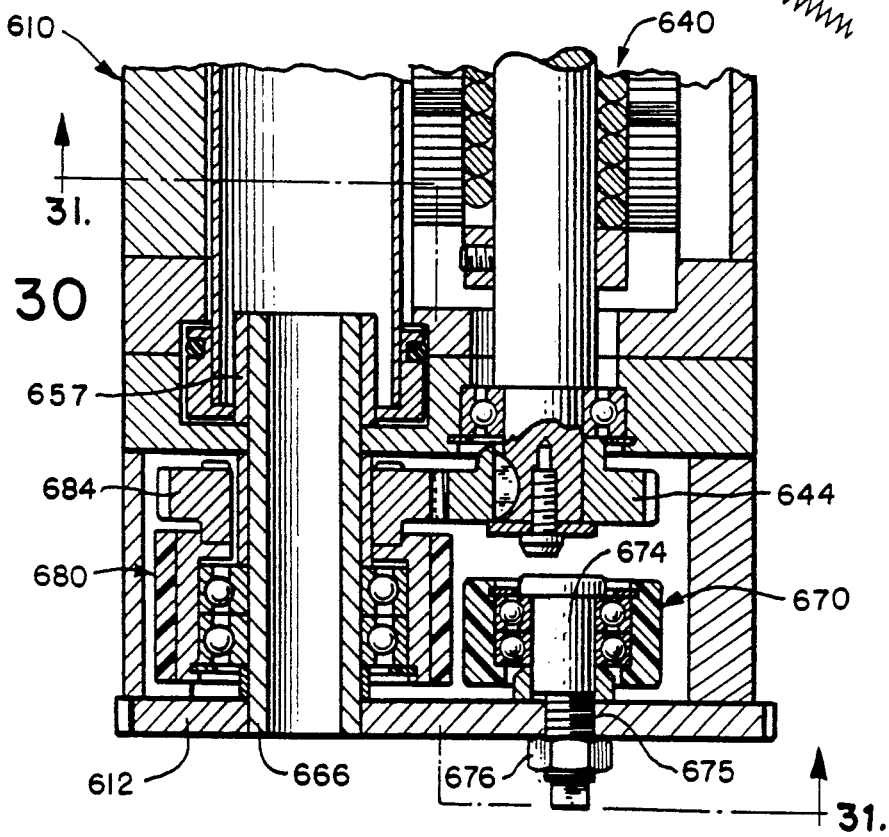

DRY BRUSH CLEANING APPARATUS AND METHOD FOR CLEANING PRINTING PRESS BLANKET CYLINDERS

BACKGROUND OF THE INVENTION

This invention relates to a method and apparatus for maintaining a clean printing surface on a blanket cylinder of a printing press such as a web offset press, or the impression cylinder of a letter press or a gravure press, during the printing operation. The blanket or impression cylinders of these presses tend to rapidly accumulate foreign material such as lint, dust and ink on their peripheral surface portions, which negatively affects the quality of the printed product. The cylinders must, therefore, be cleaned in order to remove this foreign material. One way of cleaning these cylinders has been to periodically discontinue printing and manually wash off the rotating blanket cylinders with a solvent soaked rag. This operation can be extremely dangerous, and it is additionally undesirable because of the press shutdown time required.

Other methods and apparatuses for cleaning blanket cylinders are disclosed in Switall U.S. Pat. No. 3,508,711 and Anderson et al. U.S. Pat. No. 3,486,448. In accordance with these patents, the cleaning is accomplished by spraying solvent onto the blanket cylinders and onto the paper web while the press is running. The foreign material is thus washed from the blanket cylinder surface and adheres to the paper web which is moving through the press. While this type of an arrangement is a significant improvement over manual washing of the blanket cylinder, it still requires the utilization of volatile solvents, and the actual printing operation must be interrupted during the cleaning operation.

Another method for cleaning blanket cylinders is disclosed in U.S. Pat. Nos. 4,875,412 and 4,667,597 to Wright, et al. The cleaner disclosed in these patents incorporates a non-rotating brush periodically urged against the blanket cylinder. Disposed beneath the brush is a lint catcher. As the brush is retracted, a hinged door on the lint catcher opens to receive dust and lint loosened by the brush. The specification states that fluid or vacuum devices may be employed to provide for automatic removal of lint and debris from the lint catcher. The specification states that the invention may be used during the uninterrupted course of a press run. However, in practice, printers using the commercial embodiment of the disclosed device prefer to cycle the cleaning operation during the time period when a splice between two paper webs occur. This is because the operation of the cleaning device produces a noticeable affect in the printing, requiring the printed material to be rejected. However, the material printed during the splice is also rejected, so one rejected section of the web will contain the results of both the splice and the cleaning operation.

One disadvantage of cleaning only on the splice is that lint buildup may be excessive before the splice occurs. Also, if more frequent cleanings could be made, the overall printing quality would be improved as less lint would build up between cleanings.

Another disadvantage of the commercial embodiment of the Wright, et al. device is that the printing tends to be smeared during the cleaning cycle. This is due to the fact that a portion of the ink transferred to the blanket remains on the blanket after contacting the web. Usually this does not cause a problem because the new print image and the leftover image are always synchronized as a result of adherence to strict tolerances on the diameter of the blanket cylinder and plate cylinder. However, when the brush of the commercial Wright, et al. device contacts the blanket, the residual ink is smeared slightly. Thus, on the next revolution, the fresh ink and residual ink are not perfectly aligned, resulting in what is known as a "slurred image" print.

Another disadvantage of the commercial device is that the brushes tend to cause the blanket on the cylinder to bunch up and form a hump at the trailing edge where the blanket is secured into the blanket cylinder. This is caused, in part, because the force used to hold the brush in a cleaning position all bears on the blanket. The result is excessive wear at the hump, and reduced blanket life, as well as poor quality printing during the cleaning cycle.

Another drawback to prior art cleaning devices is that most blanket cylinders are mounted on the press frame so that they can print in either of two positions (sometimes referred to as a "black" position and a "three color" position). Also, the blanket cylinder may be moved to an intermediate position (sometimes referred to as an "off" position). In this position, the blanket cylinder is not in contact with the plate cylinder or the other blanket cylinder (used for two-sided printing). This prevents flattening of the blanket cylinder surface which would otherwise occur. It would be preferable to be able to use a single cleaning apparatus to clean the blanket cylinder in all of its possible positions, without using a complicated mounting systems in the crowded area available on the press frame.

SUMMARY OF THE INVENTION

The present invention is intended to eliminate these problems by cleaning the foreign material from the surface of the blanket cylinders without solvent and by effecting this cleaning operation at any desired frequency while the press is printing. The invention provides a constant, effective and relatively inexpensive method and apparatus for maintaining the surface quality of the blanket cylinders, eliminating the need for cleaning solvents and reducing the waste of paper stock which previously was used to blot the solvent from blanket rolls.

In one aspect, the invention comprises frame means spanning the width of the working surface of the blanket cylinder; a plurality of rollers, at least one of which is secured to each end of the frame means, the rollers being positioned to straddle the blanket and engage the bearer surfaces of the blanket cylinder, at least one of the rollers being a drive roller; a cleaning brush rotatably mounted on the frame means; drive means interconnecting the drive roller and the cleaning brush to cause power developed by frictional engagement of the drive roller and the bearer surface to impart rotation to the cleaning brush; and means for delaying a cleaning engagement of the cleaning brush with the blanket cylinder until after power generated by frictional engagement of the drive wheel with the bearer surface has caused the cleaning brush to begin rotating.

In another aspect of the invention, the cleaning brush has a longitudinal cross section of differentially spaced bristle elements, such that in a plurality of areas the bristle elements are densely packed, and in the spaces between the plurality of densely packed bristles the bristles are sparsely placed, and the densely packed areas are offset circumferentially such that during rotation of the cleaning brush while the apparatus is in a cleaning position, each area of the blanket is sequentially contacted by densely packed and sparsely placed bristles.

In another aspect, the invention comprises an apparatus for removing lint from the surface of a blanket cylinder of a printing press comprising a cleaning brush rotatably mounted on the press frame; drive means for causing rotation of the cleaning brush; and means for engaging the drive means to begin rotation of the cleaning brush before the cleaning brush is brought into cleaning contact with the blanket cylinder.

In another aspect, the invention comprises an apparatus for removing lint from the surface of a blanket cylinder of a printing press comprising a cleaning brush rotatably mounted on the press frame, and drive means for causing rotation of the cleaning brush in cleaning contact with the blanket cylinder and in a direction opposite to the tangential direction of rotation of the blanket cylinder and at a speed in excess of the blanket tangential speed.

Compared to other dry blanket cleaning systems, the present invention allows for quality printing work while the cleaner is in operation. Also, the mounting structure for the invention is simple, yet it allows the cleaner to clean the blanket in any of its normal operating or intermediate positions.

There are numerous other advantages of the invention which, along with the invention itself, will best be understood in view of the drawings, a brief description of which follows:

BRIEF DESCRIPTION OF THE DRAWINGS

FIG. 1 is a perspective view of two dry brush cleaners of the present invention installed on a press frame, one being associated with each blanket cylinder of a common two-sided web offset press.

FIG. 2 is a plan view taken along line 2—2 of FIG. 1.

FIG. 5 is a cross-sectional view taken along line 5—5 of FIG. 3, with the cleaning apparatus in its cleaning position.

FIG. 6 is a cross-sectional view also taken along line 5—5 with the cleaning apparatus in its retracted position after the cleaning engagement with the blanket cylinder.

FIG. 7 is a cross-sectional view taken along line 7—7 of FIG. 3.

FIG. 8 is an end plan view, partially broken away, taken along line 8—8 of FIG. 3.

FIG. 9 is a cross-sectional view taken along line 9—9 of FIG. 8.

FIG. 13 is a schematic diagram depicting the hydraulic system of the cleaning apparatus of FIG. 3.

FIG. 14 is an enlarged cross-sectional view taken along line 14—14 of FIG. 16.

FIG. 18 is a perspective view of the actuation cylinder which moves the cleaner into and out of cleaning position, shown attached to the press frame in FIG. 1.

FIG. 19 is a cross-sectional view taken along line 19—19 of the actuation cylinder of FIG. 18.

FIG. 20 is a cross-sectional view taken along line 20—20 of the actuation cylinder of FIG. 18.

FIG. 21 is a cross-sectional view taken along line 21—21 of the actuation cylinder of FIG. 18.

FIG. 23 is a cross-sectional view showing an air spiral optionally placed within the inlet blow-out tube of the cleaner of FIG. 1.

FIG. 24 is a cross-sectional view taken along line 24—24 of FIG. 23.

FIG. 25 is a perspective view of a clean-out brush optionally placed within the lint collection chamber of the cleaner of FIG. 1.

FIG. 26 is a plan view of the clean-out brush of FIG. 25.

FIG. 27 is a cross-sectional view showing the clean-out brush of FIG. 25 in its operating position within the closed lint collection chamber of the cleaner of FIG. 1.

FIG. 28 is cross-sectional view showing the mounting bearing of the clean-out brush of FIG. 25 set within the shutter forming the lint collection chamber of the cleaner of FIG. 1.

FIG. 29 is a schematic view of another embodiment of a dry brush blanket cleaner of the present invention.

FIG. 30 is a cross-sectional view taken along line 30—30 of FIG. 29.

FIG. 31 is a partial sectional view taken along line 31—31 of FIG. 30.

FIG. 32 is a schematic view of the closure mechanism for the lint chamber of the dry brush cleaner of FIG. 28.

DETAILED DESCRIPTION OF THE DRAWINGS AND PREFERRED EMBODIMENT OF THE INVENTION

Figures 3, 4:
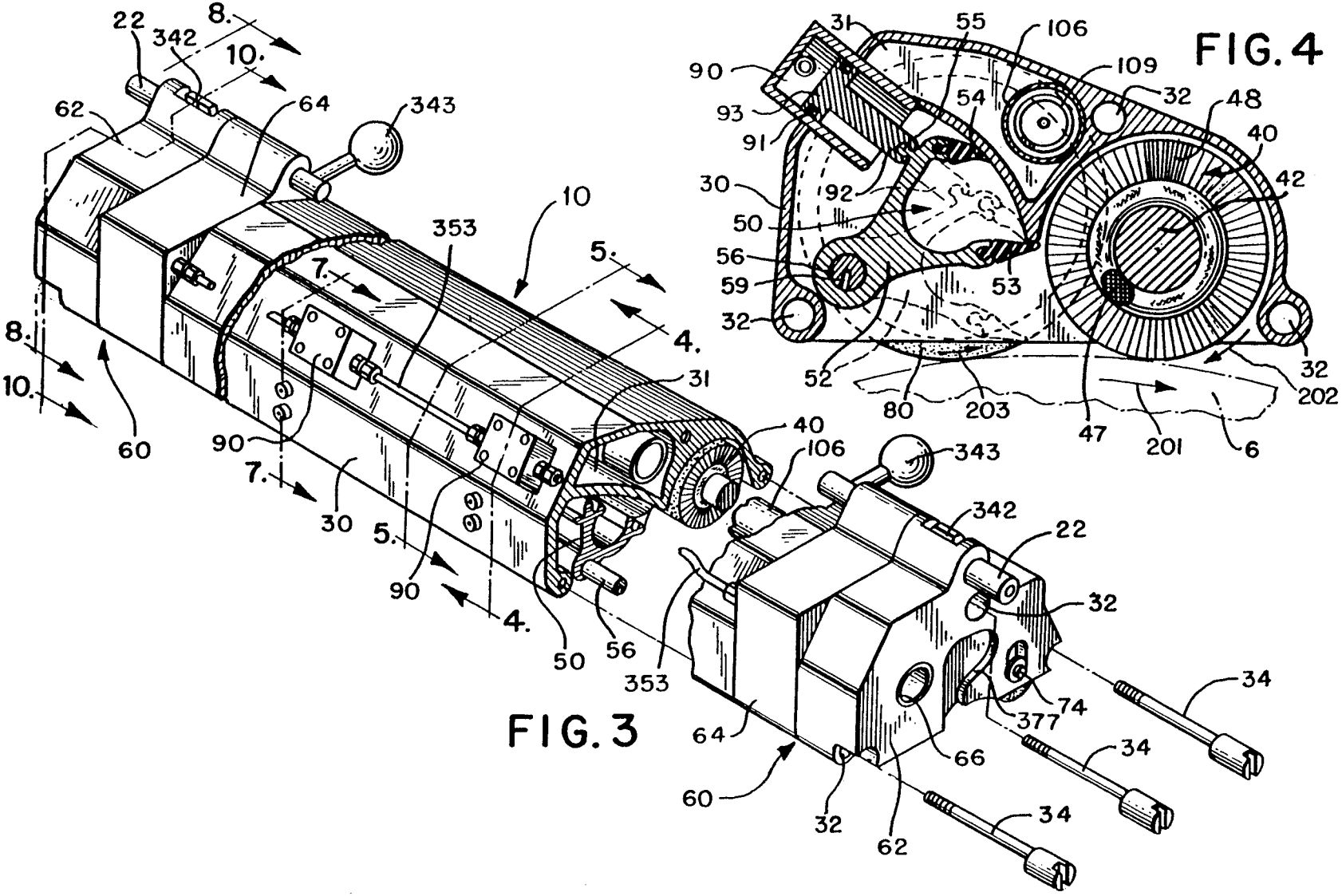
FIG. 3 is a perspective view, partially broken, of one of the dry brush cleaners shown in FIG. 1.
FIG. 4 is a cross-sectional view taken along line 4—4 of FIG. 3.
Figure 10:
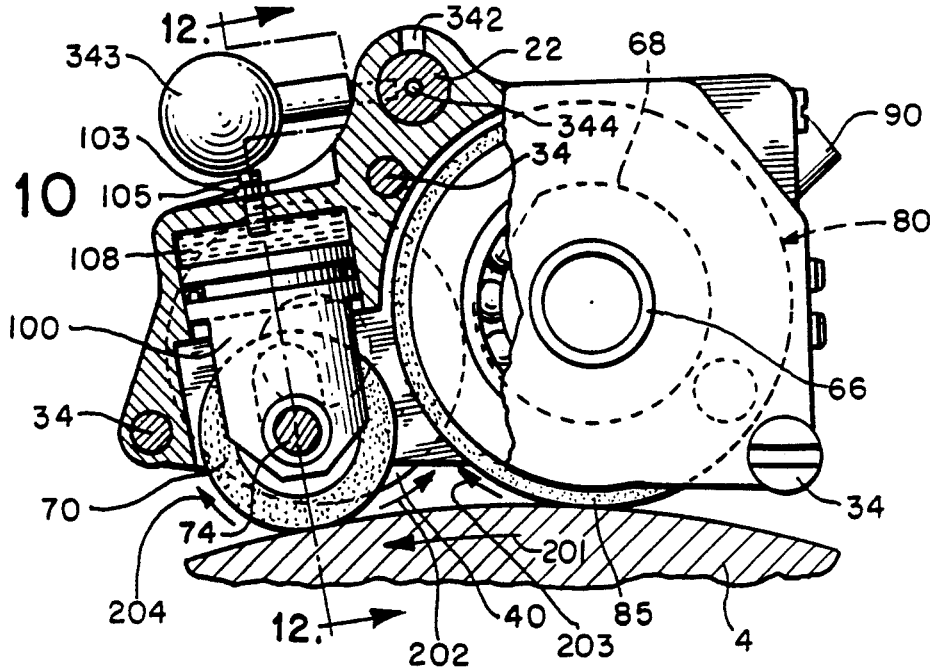
FIG. 10 is a partial sectional view taken along line 10—10 of FIG. 3.

As shown in FIG. 1, the cleaning apparatus 10 of the present invention is preferably secured to a press frame 2 above a blanket cylinder 4. (As used herein and in the claims, the term blanket cylinder also includes the impression cylinder of a letter press or gravure press). As shown in FIG. 1, when the blanket cylinder 4 is part of a double sided offset press arrangement, another cleaner 10' will preferably be mounted above the other blanket cylinder 4'. The blanket cylinder 4 carries a blanket 6 around its circumference. The ends of the blanket are captured in a groove (not shown) running longitudinally on the surface of the blanket cylinder. Beyond the edges of the blanket 6 most blanket cylinders comprise bearer surfaces 7. Ink from an ink source is supplied to a plate cylinder 8, which picks up ink in the form of an image. That ink is then transferred to the blanket 6. A web of paper 9 passing between the nip of two blanket cylinders 4 and 4' is printed with the ink from blankets 6 and 6'. After printing, the blankets 6 and 6' rotate past the cleaners 10 of the present invention.

In the preferred embodiment, the cleaning apparatus 10 is attached to the press frame 2 through mounting means comprising actuation cylinders 20, secured to each side of the press frame 2 (see FIG. 2). A locking pin 22 affixed to each end of the cleaner 10 pivotally mounts into a hole in the side of each cylinder 20.

As shown more fully in FIG. 3, the preferred cleaning apparatus 10 generally comprises a frame 30, a cleaning brush 40, a lint collection chamber 50 and drive wheel assemblies 60, mounted on both ends of cleaner 10. The frame 30 spans the width of the working surface of the blanket cylinder 4 which carries the blanket 6. The drive wheel assemblies 60 are positioned to straddle the blanket 6 and ride on the bearer surfaces 7, (as shown in FIG. 2). If the blanket-end capturing groove runs the entire length of the blanket cylinder, the present invention can still be used by creating bearer surfaces, such as by filling in the groove at the ends of the cylinder beyond the working surface of the blanket cylinder, or attaching collars to the ends of the cylinder.

The frame 30 is preferably constructed of extruded aluminum, having a cross section as shown in FIGS. 3–6. Three holes 32 are drilled into each end of the frame 30 and tapped. Machined end blocks (described below) can then be bolted to the frame 30 by threaded tie rods 34. In the preferred embodiment, the frame 30 with attached end blocks constitute a frame means for the cleaner 10.

Figure 11:
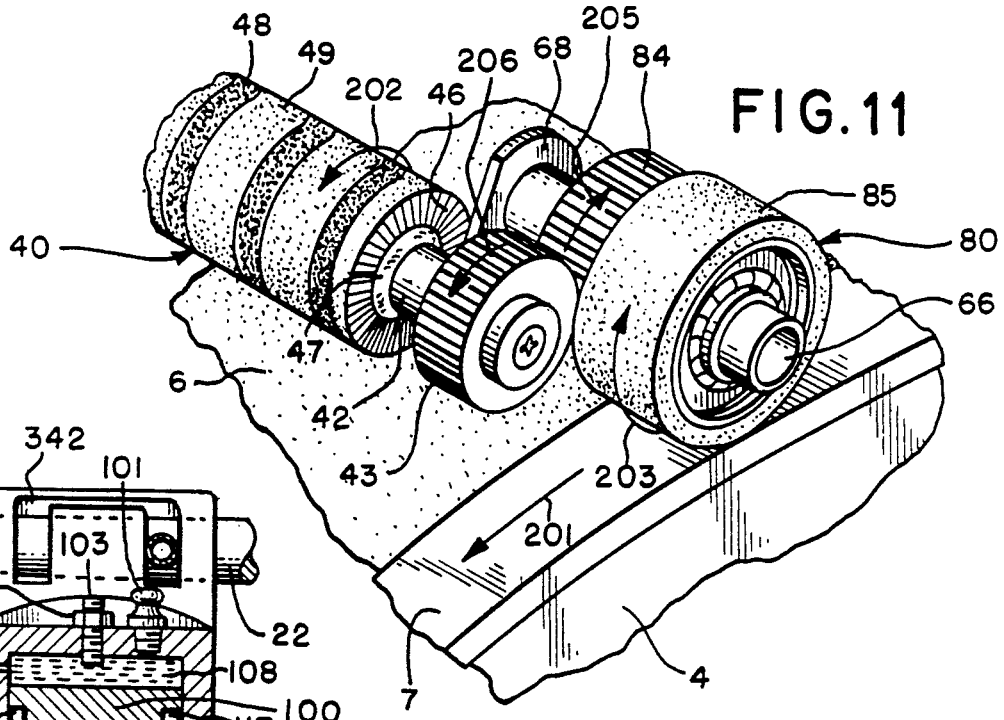
FIG. 11 is a schematic view of the rollers, gears and brush of the cleaning apparatus of FIG. 3 shown in its operational position.

Journaled within the end blocks and rotatably mounted within the frame means is a cleaning brush 40, best seen in FIG. 11. The brush 40 preferably has a steel core 42 and bristles 46 held in place by a cord 47 helically wound around the core 42 and hardened with an epoxy material (see FIG. 9). In the preferred embodiment, the bristle spacing on the brush 10 creates a unique pattern of alternating densely packed areas 48 and sparsely placed areas 49. These different areas are offset circumferentially such that during rotation of the brush 40, while the cleaner 10 is in its cleaning position, each area of the blanket 6 is sequentially contacted by densely packed areas 48 and sparsely placed areas 49. This type of arrangement may preferably occur by aligning the densely packed area 48 in a helical pattern, filling in all the remaining area with sparsely placed bristles 46, as shown in FIG. 11.

Figure 22:
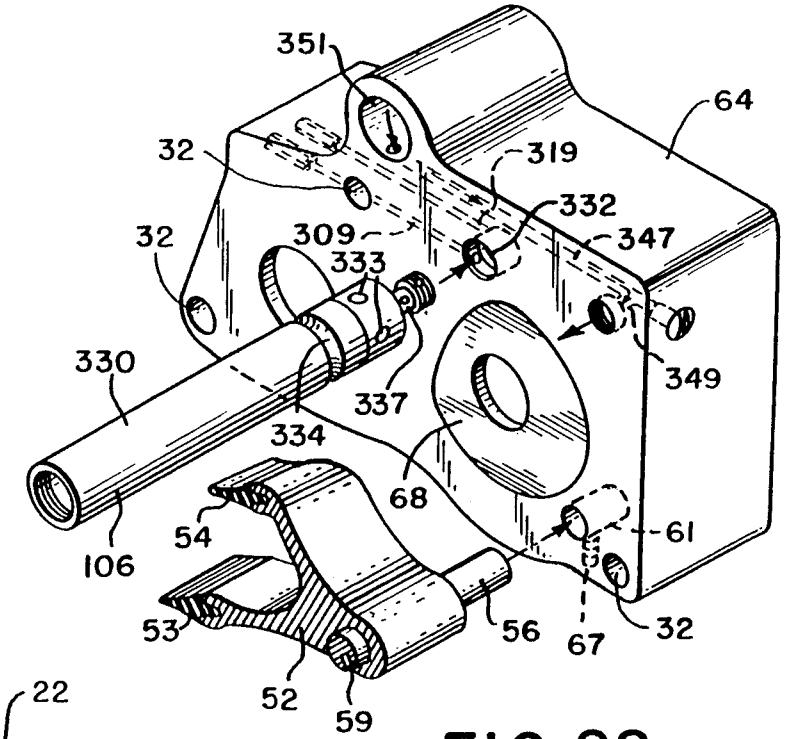
FIG. 22 is an exploded view showing the relative position of some of the elements of the cleaner of FIG. 1.

Also mounted on the frame 30 is a pivotable shutter member 52 which forms a lint collection chamber 50. The shutter member 52 is also preferably extruded aluminum having a generally U-shaped cross-section as shown in FIGS. 4–6 and 22. Extending along the longitudinal extremities of shuttle member 52 are sealing lips 53 and 54, both with the same cross section, as shown in FIGS. 4–5 and 22. The lips 53 and 54 are preferably extruded rubber. The shape and position of lips 53 and 54 make it possible for the lips 53 and 54 to cooperate with the inside surface 36 of frame 30 to seal the lint collection chamber 50 in its normal position (FIG. 6). When the cleaner is activated (FIG. 5), sealing lip 54 still seals against inside surface 36 to prevent lint and other debris from entering and fouling the area 38 which houses the opening actuation means for the lint collecting chamber 50.

In the preferred embodiments, the opening actuation means comprises one or more (preferably four) pneumatic cylinders 90 mounted to frame 30. FIG. 4 shows the action of the cylinders 90 and the relative position of the shutter 52 in its open and closed positions. A huvacup 91 seals the bore inside cylinder 90 around a piston 93. A shaft 92 extending from the piston 93 connects to a rib 55 formed on the back side of shutter member 52. The notch in the end of shaft 92 requires the cylinder 90 to be slipped onto the end of rib 55 and slid into position during construction of the cleaner, thus providing a simple but positive connection between the cylinders 90 and shutter member 52.

The shutter member 52 is maintained in its normally closed position by the action of a torsion shaft 56 and springs 57. The torsion shaft 56 is held in position by mounting blocks 58, held onto frame 30 by screws 51, as best seen in FIGS. 5-7. The torsion shaft 56 is also held into position in the end blocks, as described below. A keyway 59 running the length of the shaft 56 holds one end of each of the springs 57. The other end of each of the springs 57 is biased against the bottom side of shutter element 52. Shutter element 52 is machined to allow space through which mounting blocks 58 extend. As seen in FIGS. 5 and 6, the flat 98 machined into the shutter 52 cooperates with mounting block 58 to form a stop position, limiting the rotation of shutter element 52 about torsion bar 56 when the cylinders 90 are actuated.

FIG. 22 shows how the torsion shaft 56 is secured into bearing plate 64. During assembly of the cleaner 10, the end of shaft 56 fits into a hole 61 in the bearing plate 64. A special tool (not shown) is used to rotate the shaft 56, tensioning springs 57 to hold shutter element 52 in its closed position. After the shaft 56 is torsioned, locking screws 67 are tightened to hold the shaft 56 secure.

As shown by arrow 201 and 202 in FIG. 5, in the preferred embodiment the brush 40 rotates in a direction so that its bristles 46 move in a tangential direction opposite to the tangential direction of movement of blanket 6, as viewed at their point of contact. In this manner, lint and other debris on the surface of the blanket 6 are swept from the blanket and flicked into chamber 50 when the cleaner 10 is in its cleaning operation. When the cleaning cycle stops, the springs 57 cause the shutter element 52 to rotate back to its closed position (FIG. 6). The lips 53 and 54 seal the chamber 50, and compressed air introduced at one end of the chamber 50 will blow through the chamber 50 and carry the lint and other debris out the other end of the chamber 50.

In the preferred embodiment, the source of power to rotate brush 40 comes from the printing press itself, through frictional engagement of one or more drive rollers against the bearer surfaces 7. In the preferred embodiment, a drive roller is secured to each end of the frame 30 as part of a drive assembly 60.

One drive wheel assembly 60 is shown in FIGS. 8–11. The other drive wheel assembly, secured to the opposite end of frame 30, is exactly the same except that some parts have a left hand/right hand orientation. The assembly 60 is constructed of two end blocks, the end plate 62 and the bearing plate 64. Generally, the end plate 62 houses the idler roller 70 and the drive roller 80, and the bearing plate 64 houses the drive means connecting the drive roller 80 and the cleaning brush 40.

As best shown in FIG. 9, extending through both plates 62 and 64 is a blow-out tube 66. The outside end of the blow-out tube 66 is connectable to a source of compressed air, as discussed below. The inside end of blow-out tube 66 is piloted to accept a cheek plate 68, held in position against the end of the lint collection chamber 50 by springs 69. The check plate provides a loose seal for the air flow path between the bearing plate 64 and lint collection chamber 50.

The end plate 62 also houses a piston 100 connected to idler roller 70. The piston 100 is part of a hydraulic circuit (see FIG. 13) which is used to delay engagement of cleaning brush 40 with blanket 6 until the brush 40 is already rotating. The idler roller 70 itself preferably comprises a nylon wheel 72 on an axle 74, with bearing assemblies 76 in between. The inside end of axle 74 comprises a head 75. The outside end of axle 74 is machined to accept a washer 77 held in place by a snap ring 78. The head 75 and washer 77 secure the roller 70 in the end plate 62. Spacers 71 hold the bearing assemblies 76 in the proper place on the axle 74. The inside of the wheel 72 is grooved to accept an internal snap ring 79 to properly position the wheel with respect to the bearing assemblies 76. The end plate 62 contains a slot 63 in its outside end surface (best seen in FIG. 8) through which the axle 74 extends. The slot 63 allows for relative movement between the axle 74 and the end plate 62, as described more fully below.

The end plate 62 also houses the drive roller 80, although the core 82 of drive roller 80 extends to form a drive gear 84, which is actually housed in the bearing plate 64. The drive roller 80 uses the blow-out tube 66 as its axle. A snap ring 65 fixes the blow-out tube 66 in the bearing plate 64. Bearing assemblies 86 ride between the core 82 and the blow-out tube 66. Spacers 81 position the bearing assemblies 86 on the blow-out tube 66 between the snap ring 65 and the inside surface of end plate 62. An internal snap ring 89 and the internal shape of core 82 positions the core 82 with respect to the bearing assemblies 86. A rubber drive wheel 85 surrounds the radial periphery of the core 82.

Keyed onto the end of brush core 42 and housed within bearing plate 64 is a brush gear 43, which intermeshes with gear 84 from the drive roller 80. The brush core 42 rides on a bearing assembly 45 inside the bearing plate 64. A snap ring 41 holds the bearing assembly 45 in place in the bearing plate 64. A wave spring washer 44 acts as a spacer and is used to take up free play between the bearing assembly 45 and the inside surface of the bearing plate 64. A countersunk washer 37 holds the gear 43 in place. Core 42 is tapped and a screw 39 is used to hold the washer 37 in place.

As shown by arrows 201–206 in FIG. 8, when the cleaner engages the bearer surface 7, rotating in a counter clockwise direction, the idler roller 70 and drive roller 80 start rotating in a clockwise direction, as does drive gear 84. Gear 84 drives brush gear 43 in a counter clockwise direction, which in turn causes the brush 40 to start rotating in a counter clockwise direction. Thus the gears 84 and 43 serve as a drive means interconnecting the drive roller 80 and the cleaning brush 40 to cause power developed by frictional engagement of the drive roller 80 and the bearer surface 7 to cause rotation of the cleaning brush 40.

FIG. 8 shows the drive roller 80 engaged but the brush 40 still not in contact with the blanket 6. This is because the cleaner includes means for delaying a cleaning engagement of the brush 40 with the blanket cylinder 4 until after power generated by frictional engagement of the drive roller 80 with the bearer surface 7 has been imparted to begin the rotation of the cleaning brush 40.

Figure 12:
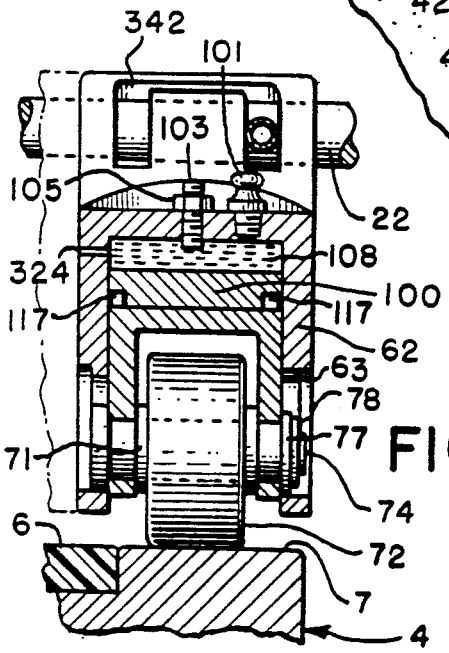
FIG. 12 is a cross-section view taken along line 12—12 of FIG. 10.

In the preferred embodiment, this means for delaying engagement comprises the piston 100 housed in the end plate 62 (best seen in FIG. 12) and a hydraulic circuit connected thereto, shown schematically in FIG. 13. As hydraulic fluid is pushed out of the cavity 108 by piston 100, the axle 74 moves within slot 63 and the brush 40 settles down into contact with the blanket 6, as shown in FIG. 5, until the top of piston 100 contacts the bottom of set screw 103, which acts as a stop. A jam nut 105 holds set screw 103 in position once this stop position has been set. A huva-cup 107 seals piston 100 in cavity 108.

The hydraulic circuit comprises a number of passageways, flow control valve 102, check valve 104 and an accumulator 106. Hydraulic fluid is charged to the system through grease fitting 101, threaded into a hole through the top of end plate 62 and tapped into cavity 108, shown in FIG. 12. The hydraulic circuit will best be understood by first viewing the schematic drawing of FIG. 13 to understand the system's operation.

When the cleaning apparatus 10 is first placed in contact with the blanket cylinder 4, the idler roller 70 contacts the bearer surface 7, but cleaning engagement of the brush 40 is delayed. Force exerted on the idler roller 70 by actuation cylinder 20 is transmitted through axle 74 to the forks of piston 100. Hydraulic fluid in the cavity 108 above the head of piston 100 is forced out delay period. The flow path 110 leads to both a check valve 104 and a flow control valve 102, positioned respectively in parallel flow paths 111 and 112. Check valve 104 is positioned to prevent fluid flow through path 111 when piston 100 is forcing fluid out of cavity 108. This forces all fluid to take path 112 through flow control valve 102, which restricts its flow. From flow control valve 102 the fluid flows via paths 113 and 115 into accumulator 106. A moveable piston 107 is biased by a spring 109 toward the inlet side of accumulator 106. However, the force generated by spring 109 is overcome by the force of the piston 100 exerted on the fluid and hence to piston 107. Fluid thus flows into accumulator 106, forming a reservoir 116 behind piston 107.

After the cleaning operation ends, the cleaner 10 is lifted away from the blanket cylinder 4. Now spring 109 acts as a return pressure means for forcing fluid from the reservoir 116. The spring 109 acts against piston 107 to force fluid out of accumulator 106 into path 115. In this direction of flow, check valve 104 allows fluid to flow relatively freely through paths 114 and 111. Some flow through path 112 and flow control valve 102 also occurs. The fluid is thus forced back through path 110 into cavity 108, forcing piston 100 back into its extended mode, thus resetting the cleaner idler roller 70 for the next cleaning operation.

The details of the flow control valve 102 and check valve 104 are best seen in FIG. 14. Both are housed in bearing plate 64. Flow control valve 102 comprises a threaded held 302 and a shank 304 which is further machined to provide a recess 305 for an O-ring 306 to sealingly engage the shank 304 into bore 307 within bearing plate 64. At the end of the shank 304 opposite the head 302 the shank 304 has a bevel 308. A passageway 309 is formed at the base of bore 307. The bevel 308 cooperates with the opening of passageway 309 to limit the flow of fluid through passageway 309. The degree of restriction is controlled by rotating head 302, which includes an allen wrench socket, to force shank 304 and hence bevel 308 closer to or further from blocking the opening of passageway 309.

The check valve 102 also comprises a head portion 312, which contains a space for O-ring 313 to seal bore 317 in bearing plate 64 which holds check valve 102. The upper half of shank 316 of check valve 102 is threaded, and cooperates with threads inside of bore 317 so that check valve 102 can be tightened into a sealing position. The lower half of shank 316 is machined to provide a flow path around shank 316 inside of bore 317. Also, the lower half of shank 316 is drilled out to provide a cavity 315 housing spring 314. Spring 314 urges a ball 318 into the opening of passageway 319 formed in the base of bore 317.

A fluid passageway 324 through end plate 62 (corresponding to path 110 in FIG. 13) leads from cavity 108 behind piston 100 (see FIG. 12) to the inward side of end plate 62. Passageway 324 there connects to passageway 320 which extends from the outward side of bearing plate 64 into bore 317. An O-ring 322 seals passageways 320 and 324 at the junction of end plate 62 and bearing plate 64. Bore 317 is connected by fluid passageway 321 to bore 307. When fluid is flowing out of the cavity 108 (in the direction opposite to arrows 222), ball 318 seals the entrance to passageway 319 corresponding to path 114 of FIG. 13), and all fluid is forced into passageway 309 (corresponding to path 213 in FIG. 13).

Figure 15:
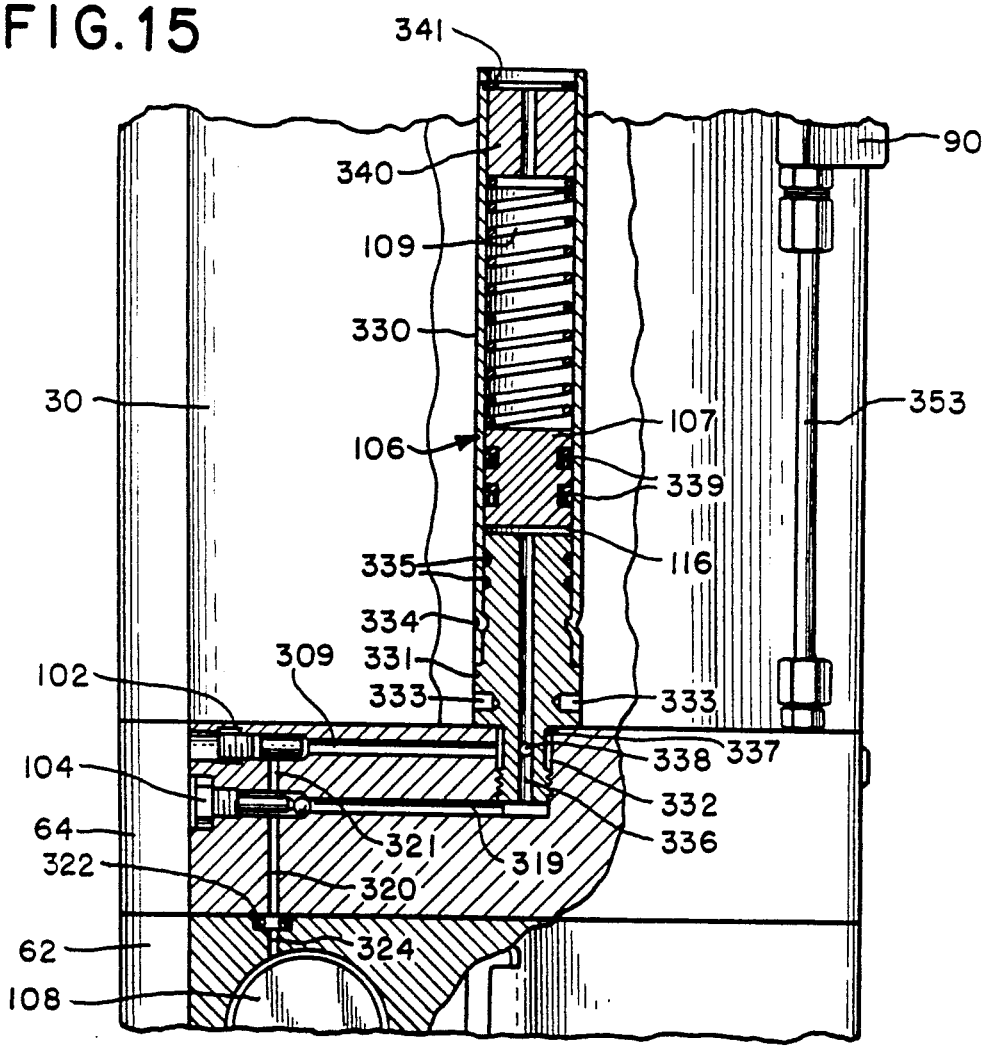
FIG. 15 is a partial sectional view taken along line 15—15 of FIG. 16.

The construction of accumulator 106 is best seen in FIG. 15. The body of the accumulator is a cylindrical tube 330. A reservoir orifice piece 331 is machined to fit partially inside tube 330. The other end of the orifice piece 331 is threaded for engagement with a tapped hole 332 on the inward side face of bearing plate 64. The accumulator 106 fits inside of a cavity 31 inside the extrusion of frame 30, as seen in FIGS. 3 and 4. Wrench pin holes 333 are formed in the shoulder of orifice piece 331 to aid in tightening it into bearing plate 64. A roll crimp seal 334 and O-rings 335 seal the tube 330 around the orifice piece 331. A hole 336 is drilled longitudinally through the orifice piece 331 so as to be in fluid communication with passageway 319. Also, the threaded end of orifice piece 331 is machined to a smaller diameter neck 337 and drilled with holes 338 to allow fluid from passageway 309 to communicate with longitudinal hole 336. Moveable piston 107 is sealingly disposed within tube 330 by huva-cup seals 339. On the back side of spring 109 is a hydraulic cylinder plug 340, which is held into the tube 330 by an internal snap ring 341.

During compression of piston 100, the fluid flows from passageway 309 around neck 337 into holes 338 and through longitudinal hole 336 (corresponding to path 115 in FIG. 13). Incoming fluid pushes piston 107 back, forming a reservoir 116 between the orifice piece 331 and the piston 107. When the cleaner 10 is retracted to its normal position, the delay mechanism resets. Fluid forced out of tube 330 flows out hole 336 and into both of passageways 309 and 319. The check valve ball 318 now allows fluid to enter bore 317, and flow back to cavity 108 through passageways 320 and 324, as shown by arrows 222.

Figure 17:
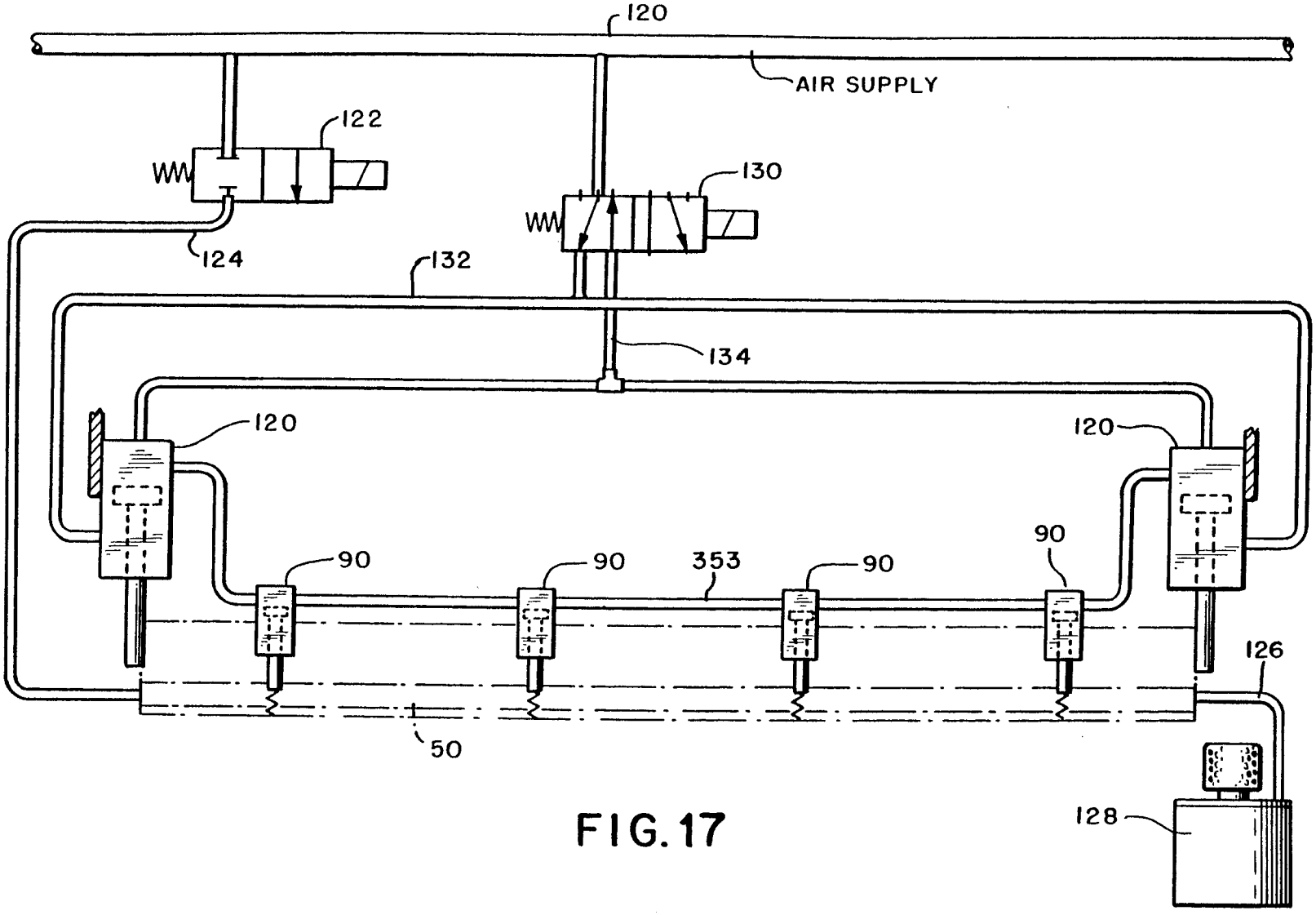
FIG. 17 is a schematic diagram depicting the pneumatic circuits within the cleaner of FIG. 3.

There are two pneumatic circuits used in the preferred embodiment of the invention, both shown in FIG. 17. The simpler circuit provides compressed air to blow-out the lint collecting chamber 50. As shown in FIG. 17, this circuit comprises a solenoid valve 122 connected to air supply 120. Valve 122 is shown in its normally closed position. After the cleaning cycle is completed and the lint catcher is rotated back to its closed position, a control signal causes valve 122 to open, allowing compressed air to flow through a flexible conduit 124 (shown schematically in FIG. 17) into the lint collecting chamber 50. Preferably, the air pressure is sufficient to cause turbulent flow in the chamber 50. The flowing air picks up lint and other debris and passes through flexible conduit 126 into a dust collector canister and air filter 128, preferably mounted on the press frame in an easily accessible location.

The other pneumatic circuit shown in FIG. 17 comprises the control circuit for the cleaner. Air from supply 120 is first directed through a two position solenoid valve 130. In its normal position, valve 130 directs air through conduit 132 to the "off position" air connection of actuation cylinders 20 (discussed below). However, when actuated into its operational position, air flows through valve 130 into conduit 134 and into the "actuation position" air connection of actuation cylinders 20. A passageway through cylinders 20 also feeds air through locking pins 22 (described below) and eventually to the piston side of shutter air cylinders 90, causing the lint collection shutter 52 to rotate to an open position as shown in FIG. 5.

At the end of the cleaning cycle, valve 130 returns to the position shown in FIG. 17, the actuation cylinders 20 lift the cleaner away from the blanket cylinder 4, and springs 57 force the lint collection shutter 52 closed, forcing the pistons 93 in shutter air cylinders 90 back to the position shown in FIG. 4.

The solenoid valves 122 and 130 are preferably electrically controlled from the quite room associated with the press operation where other press controls are located. Any variety of control systems can be used. Preferably, a programmed control will signal the solenoids to automatically operate at a set number of impressions, such as 15,000 or any other number, depending on the lint buildup condition on the blanket 7. Of course a straight timer controlled circuit could also be used to automatically cycle the cleaner every certain time period, such as every 15 minutes. The system should also be equipped to operate on demand if an operator wants to manually instigate a cleaning cycle. In the preferred embodiment, the cleaning cycle lasts for 10 seconds.

If a large number of cleaners of the present invention are in use simultaneously (as would be common in a newspaper printing operation where there are often dozens of blanket cylinders in use and in need of cleaning), it would be advantageous to stagger the control impulse for opening valve 122 so that not all lint collection chambers in the press room are cleaned out simultaneously. This will allow for the maximum air pressure to be used for each blow-out operation, and reduce the required compressed air capacity for the press room.

FIGS. 18–22 show the construction of the actuation cylinders 20, the locking pins 22 and the various air passageways used in the pneumatic circuits.

The locking pin 22 fits through a hole 350 in end plate 62 and an aligned hole 351 in bearing plate 64. A knob 343 is attached radially to the end of locking pin 22 to help slide and rotate the pin 22 A U-shaped guide channel 342 is formed in the top of end plate 62 above the hole 350. A pin 345 (see FIG. 21*a*) set radially into locking pin 22 engages the channel 342 to provide a "dead bolt" type locking engagement of the locking pin 22 into actuation cylinders 20. (The other leg of channel 342 allows the knob 343 to be placed in an out-of-the-way position when the cleaning apparatus 10 is being installed.)

Figure 16:
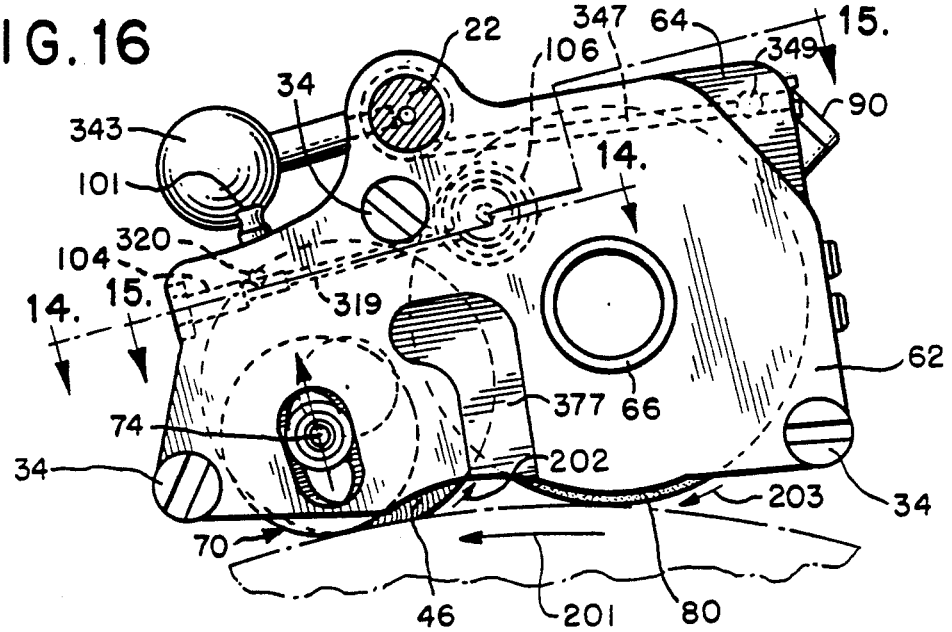
FIG. 16 is an end view taken along line 8—8 of FIG. 3, showing the cleaner in its cleaning position.

A hole 344 is drilled longitudinally into locking pin 22 from the end which fits into actuation cylinder 20. This hole is plugged by a set screw 345, but radial hole 346 provides an air path into hole 344. Holes 344 and 346 provide a channel for the air used to control the opening of the lint chamber 50. The air is supplied to the press frame 2, through the block for cylinder 20, into hole 346. At the inside end of hole 344, another radial hole 348 is drilled, which allows air to pass into a space 355 created by necking down the locking pin 22 in the vicinity of hole 348. A plugged channel 347 and cross channel 349 (FIGS. 16 and 22) in bearing plate 64 carry the air from space 355 to connected tubing 353, which in turn provides air to the various shutter air cylinders 90. (See FIGS. 3 and 15.) A huva-cup 352 surrounds pin 22 and seals hole 351 when locking pin 22 is placed in its dead bolt position. An O-ring 356 seals the other end of hole 351.

The construction of the actuation cylinders 20 is best shown in FIGS. 18–21. A cylinder 20 is constructed from five major components, a cylinder housing 380, an actuation piston 381, a reactionary piston 382, a cover plate 383 and a cartridge 360, which moves with the actuation piston 381 and receives locking pin 22.

The cylinder housing 380 is a square block of aluminum with a cylindrical core removed. Bolt holes 388 are provided on the side faces of cylinder housing 380 to use with mounting brackets to hold actuation cylinder 20 on the press frame 2. The actuation piston 381 is mainly cylindrical, and slightly smaller in diameter than the core in the housing 380. Its inside top central section is bored out with two diameter bores the larger diameter only boring out the top portion. The reactionary piston 382 is fixed in the cover plate 383, but extends into the lower, smaller diameter bored-out area inside actuation piston 381, as best seen in FIG. 20. The cover plate 383 is square, with a round pilot piece extending from its bottom surface which fits inside the top, larger diameter bored out section of actuation piston 381. An O-ring 385 seals the top of the cylinder housing 380 and the cover plate 383, which is bolted into the four corners of the housing 380 outside the hollow central core by bolts 384 (FIG. 18).

Snap rings 386 hold the reactionary piston 382 in the cover plate 383, while O-rings 387 seal the bore through cover plate 383, which holds the stem of reactionary piston 382.

Plastic wear rings 389 are used to prevent frictional wearing between the outside of actuation piston 381 and the inside wall of cylinder housing 380. A huva-cup 390 seals the actuation piston 381 inside cylinder housing 380.

Figure 21A:
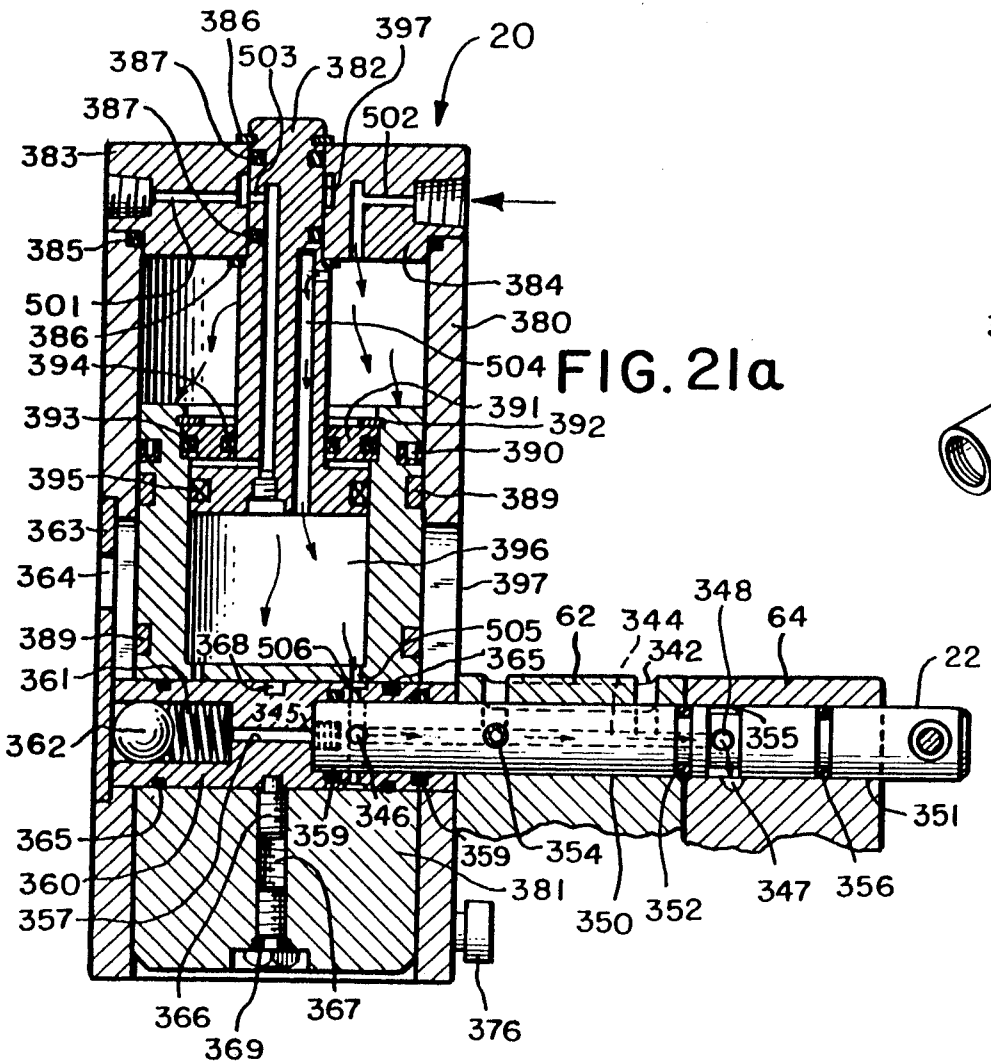
FIG. 21*a* is a cross-sectional view similar to FIG. 21 except that the actuation cylinder is shown when the cleaner is in its operational position.

The bore inside the actuation piston 381 is sealed at its top by an actuation piston cover plate 391. The plate 391 sits on the shoulder created by the different diameter bores inside the actuation piston 381. The plate 391 is held in place by a snap ring 392. Its outside surface is sealed to the bore in actuation piston 381 by an O-ring 393. The plate 391 is bored out through its center so that the stem of reactionary piston 382 will fit therein. The inside diameter is sealed by a quadrille ring 394. Also, a quadrille ring 395 is used to seal the end of reactionary piston 382 into the lower bore inside actuation piston 381, which forms chamber 396 when actuation piston 381 is in its downward position (FIG. 21*a*).

Actuation piston 381 is bored out radially so that cartridge 360 fits just below the bottom of chamber 396. The cartridge 360 is wider than the diameter of the actuation piston 381. Thus an elliptical slot 397 is formed in the inside face of cylinder housing 380 for the end of cartridge 360 to protrude through and allow vertical motion of actuation piston 381 and cartridge 360 inside cylinder housing 380. The cartridge 360 is bored longitudinally from both ends to hold the locking pin 22 on one side and a spring 361 and ball 362 on the other side. The back side face of cylinder housing 380 is machined to accept a wear plate 363, which contains a hole 364 so that ball 362 forms a detent to help hold actuation piston 381 in its up position. The cartridge 360 is sealed into actuation piston 381 by O-rings 365. It is held in place by a set screw 366 threaded in a bore 367 in the bottom center of actuation piston 381. Set screw 366 terminates in a groove 368 formed in the circumference at the center of cartridge 360. Bore 376 is sealed by a seal screw 369.

A number of air passageways are formed inside of the parts making up cylinder 20. The cover plate 383 contains an "off position" air passageway 501 and an "actuating air" passageway 502 with threaded inlets for compressed air connection fittings (See FIGS. 18 and 21*a*).

The reactionary piston 382 contains passageway 503, which communicates at its top with passageway 501. Passageway 503 is plugged at its bottom, but extends radially near the bottom of reactionary piston 382 so as to open into chamber 396 above the head of reactionary piston 382. Reactionary piston 382 also contains passageway 504, which communicates with passageway 502 and extends to the bottom of the reactionary piston 382. Actuation piston 381 includes air passageway 505 between the bottom of chamber 396 and the bore containing cartridge 360. (Actuation piston 381 has a hole similar to passageway 505 on the opposite side from passageway 505 which is unused, but which allows the actuation piston 381 to be inserted in cylinder housing 380 in either of its two possible positions.) Cartridge 360 includes passageway 506 to allow air to pass from passageway 505 into hole 346 in locking pin 22. Locking pin 22 is sealed in cartridge 360 on both sides of passageway 506 by O-rings 359. Cartridge 360 also includes a longitudinal bore 357 which allows air to escape as locking pin 22 is inserted into cartridge 360 during assembly.

The cover plate 383 is designed so that the passageways 501 and 502 will mate with passageways 503 and 504 no matter which of the four possible positions cover plate 383 is secured to the top of actuation cylinder housing 380. To this end, a groove 397 is provided in the cover plate 383 surrounding the reactionary piston 382 in the location of the inlet to passageway 503. Even though passageways 501 and 502 are shown entering opposite sides of cover plate 383, they may preferably both be located on the same side, if that makes it easier to connect the air supply lines.

Also, the passageways 501 and 502 may each be provided with check valves and flow control valves (not shown) in parallel flow paths, just as provided in the hydraulic circuit and shown in FIG. 14. These valves can then be used, instead of external control valves, to control the air flow rates in the actuation system, thus controlling the speed with which the cleaner 10 moves up and down.

When air is supplied to the "off position" passageway 501, air travels through passageway 503 and enters chamber 396 above the head of reactionary piston 382. The generated air pressure then acts against the bottom of plate 391 to hold actuation piston 381, and hence the locking pin 22 and attached cleaner 10, in the up or "off" position. This corresponds to the position of valve 130 shown in FIG. 17. When valve 130 is moved to its opposite position, air is supplied to the "actuating air"

passageway 502, and flows into the head space above plate 391 and the actuation piston 381. Passageway 504 also allows air to flow to beneath the bottom of the head of reactionary piston 382 into chamber 396. The resulting air pressure acts on the top of plate 391 and the bottom of chamber 396 to drive the actuation piston 381, and associated locking pin 22 and cleaner 10, downwardly. Air inside chamber 396 above the head of reactionary piston 382 is allowed to escape through passageways 503 and 501.

When actuating air is forced into the bottom of chamber 396, it also flows through passageways 505 and 506 into locking pin 22 through hole 346. As described above, from there air travels through longitudinal hole 344 and radial hole 348 to provide air for actuation pistons 90 and opening lint chamber 50.

At the end of the cleaning cycle, the "actuating air" is turned off and the "off position" air is turned on by valve 130. Air in chamber 396 and in the shutter actuation system is allowed to vent back out through passageways 506, 505, 504 and 502, and the actuation piston 381 is returned to its raised position as described above to undergo another cycle.

When the actuation piston 381 is in its up position, the blow-out tube 66 is aligned with the shutter blow-out air system, included in the base of cylinder 20, best shown in FIGS. 18–20. The blow-out air system comprises a copper elbow 370 which on one end is connectable to tubing which leads either to a compressed air supply 120 or to the lint collection system 128, depending on which side of the press frame 2 the cylinder 20 is mounted. The other end of the elbow 370 faces the cleaner 10. A brass holder 371 is slideably mounted in the cylinder housing 380. The actuation piston 381 is cut away on one side (FIG. 20) to provide clearance for holder 371.

The holder 371 has a face 372 designed to mate with the inlet side of the blow-out tube 66. The elbow 370 is soldered into the holder 371 so that its end is flush with face 372. Face 372 has a sloped edge to aid in sliding the face 372 into alignment with blow-out tube 66. The holder 371 is biased towards the cleaner 10 by spring 373 (FIG. 19).

A snap ring 374 holds the end 375 of holder 371 in the cylinder housing 380. The spring 373 causes the face 372 to butt up against the blow-out tube 66 when the cleaner is in its up position. The valve 122 is then activated to allow air to flow through the elbow 370 so that it enters the chamber 50 through blow-out tube 66. On the other side of the press frame 2, the air and lint leave the cleaner 10 through the other blow-out tube 66, and the elbow 370 in the other cylinder 20.

A roller 376 mounted on the inside face of cylinder housing 380 is used to make sure that blowout tube 66 and face 372 are aligned in the "up" position. As discussed previously, the cleaner 10 is free to pivot about locking pin 22 so that the brush 40 can be held away from the blanket 6 when the drive roller 80 first engages the bearer surface 7 and until after the brush 40 has started to rotate. As the hydraulic fluid is forced out of cavity 108, piston 100 slides, allowing the cleaner 10 to pivot about locking pin 22, and rotating brush 40 then contacts the blanket 6. When the cleaning cycle is over, this pivot motion must be reversed so that the blow-out air system is aligned. To this end, a cam 377 is formed in the outside face of end plate 62 (See FIG. 3), which cooperates with roller 376 to align the face 372 with blow-out tube 66.

In another embodiment, a turbulence inducing means may be added to the pneumatic system providing air to blow through the lint collection chamber 50. The preferred turbulence inducing means is a plug 410 which fits inside the blow-out tube 66, as shown in FIGS. 23 and 24. The plug 410 has a solid central core and spiral grooves 411 in its longitudinal periphery. Air flowing through the blow-out tube 66 is thus forced through the spiral grooves 411, imparting a spiraling motion which directs the air flow against the walls of the lint collection chamber 50. This spiral motion thus helps clean out lint or other debris which might otherwise adhere to the walls of the chamber 50. In all other respects, this embodiment is identical to the preferred embodiment discussed above.

In another alternate embodiment, a clean-out brush 420 is built into the chamber 50. Preferably the brush 420 has a very loose bristle spacing so that it does not restrict air flow through the chamber 50. In one embodiment, shown in FIGS. 25–28, the bristles 421 are spaced one fourth inch apart, and aligned in four rows, 90° apart from each other. Bristles in each row are offset 1/16 inch from the proceeding row. The bristles 421 are just long enough to reach the nearest part of the wall of chamber 50 (FIG. 27). As the brush 420 rotates, every 1/16th inch inside the chamber 50 will have a bristle rotate past it.

The brush 420 is preferably supported by bearings 422 fixed at spaced intervals inside shutter element 52 (FIG. 28). Also, the brush is preferably powered by an air-powered turbine 423 (FIG. 25) mounted at the inlet end of chamber 50.

In the preferred embodiment, the flow control valve 102 is adjustable. Adjustment of flow control valve 102 will change the rate at which fluid flows out of cavity 108 and thus the delay period between engagement of the drive roller 80 and engagement of the brush 40. In the preferred embodiment, this delay period is about 3 to 5 seconds.

In the preferred embodiment, the ball 318 is a 5/32" chrome ball. The drive wheel 85 is a Buna-N covering, with a 90–100 durometer shore A hardness. The rubber is preferably roughened to a finish of a 250 micro finish. The pressure of the supply air is preferably 90 psi.

Since it is imperative not to strike the bearer surface with any hard object which is not free to rotate, it is preferred to equip the end plates 62 with a pad of nylon or other suitable material (not shown) so that if a drive roller 80 should break the pad would hit the bearer surface 7 prior to any other part of the cleaner 10 contacting the blanket cylinder 6. For this same reason, the bearing for idler roller 70 is large enough in diameter so that it extends below the forks of piston 100, and the bearing has a 16 micro finish. The surface of core 82 of drive roller 80 has a 125 microfinish and the edges are radiused so that if the covering became detached, the core 84 would not scar the bearer surface.

The brush core 42 is preferably 1" diameter steel, with an epoxy soaked cord layer 47 outer diameter of 1.6 inches. The total brush diameter is preferably 2.5 inches. The helix for the densely packed bristles 48 is preferably set on a 1" pitch. The densely packed area 48 is preferably 0.37 inches wide, and packed to 85% of manufacturing capacity, compared to the sparsely spaced area 49, where the bristles 46 are packed to 25% of manufacturing capacity. This is a ratio of 17:5. It is expected that a bristle packing ratio of between 2:1 and 5:1 will provide good quality cleaning for this embodiment of the invention. A 25% capacity corresponds to approximately 400 bristles per square inch of brush surface area.

Preferably the bristles 46 are 0.012 inches diameter nylon filaments. However, it is expected that other materials could be used to make the brush bristles. Nylon is preferred because it is flexible, has a long life, and is inert to both the ink and water on the blanket. Preferably the bristles extend radially from the core. To the extent the brush produces more resistance rotating in one direction than the other, it is preferred to mount the brush 40 in the cleaning apparatus 10 so that it produces the least amount of resistance. A brush of the preferred embodiment is manufactured by Industrial Brush Company, Inc., 105 Clinton Rd., Fairfield, N.J. 07004 as Part No. 52269 (59½" length) or Part No. 52270 (66½" length). Methods for constructing such brushes are disclosed in U.S. Pat. Nos. 3,246,931; 4,099,28 and 4,126,358, hereby incorporated by reference.

Preferably the clean-out brush 420 has a 5/16 inch diameter shaft, and is ⅞ inch in diameter across the bristles. The bristles 421 are preferably 0.016 inch diameter nylon filaments.

In the preferred embodiment, the set screw 103 which acts as a stop for piston 100 is set so that the bristles 46, if they were fully radially extended, would overlap the blanket by about 0.03 inches (or, in other words, have a 0.03 inch penetration). Of course since the bristles 46 are flexible, they do not actually penetrate the blanket 6 by anywhere near this amount.

Another less preferred embodiment of the invention is shown in FIGS. 29-32. The primary difference between this embodiment and the previously described preferred embodiment relates to the lint collection chamber and its operation, and the method by which the cleaner is activatably connected to the press frame, including the means for delaying the cleaning engagement of the cleaning brush with the blanket cylinder 4.

As shown in FIGS. 31 and 32, the lint collection chamber 650 of cleaner 610 comprises a cylindrical tube 652, with a longitudinal gap cut out for receiving the lint flicked by the brush 640. The tube 652 is rotatably mounted in a frame 630. The frame 630 cross section includes a cover element 632, positioned and shaped to provide a pocket 636 into which tube 652 can rotate while the lint chamber 650 is open, and provides a back half to close the lint chamber 650 when tube 652 is rotated to a closed position. The longitudinal edge of cover element 632 carries sealing brush 653. Another sealing brush 654 is attached to the frame 630. These sealing brushes 653 and 654 serve the same purpose as rubber seals 53 and 54, though not as well.

The tube 652 is rotated by use of wire ropes 655, one of each of which are wound around each of the ends of the tube 652. The ropes 655 are each driven by pneumatic cylinders 660, with a return spring 661 to pull the rope 655 and close the chamber 650. The pneumatic cylinders 660 are actuated by solenoid valves (not shown).

The cleaner 610 is connectable to the press frame 2 by a set of two pneumatic cylinders at each end of the cleaner 610. The cylinders are formed in a common block or housing 620, containing two pistons 621 and 622. Each piston is connected via air conduits to separate solenoid valves (not shown). The first piston 621 is used to engage the drive roller 680 against the bearer surface 7 of the blanket cylinder 4. The second piston 622 is used to engage the idler roller 670 and brush 640 after the brush 640 has started rotating. In this embodiment, the delay means comprises an electrical control circuit (not shown) to activate the solenoid valves feeding compressed air to pistons 621 and 622. When the cleaner 610 is engaged, the first valve is actuated, allowing compressed air to flow to the side of housing 620 containing piston 621, forcing the piston 621 and drive roller 680 downward, engaging the drive mechanism and starting brush 640 to rotate. Shortly thereafter the other solenoid valve is activated, allowing compressed air to flow to the side of housing 620 containing piston 622, forcing piston 622 downward so that idler roller 670 engages the bearer surface 7 and brush 640 engages the blanket 6 in a cleaning engagement. After the end of the cleaning cycle, springs (not shown) cause the pistons 621 and 622 to retract, lifting the cleaner 610 from the blanket cylinder 4. Thereafter spring 661 causes the tube 652 to rotate to a closed position, and compressed air is used to blow lint out of chamber 650 into a lint collection apparatus, similar to the operation of cleaner 10.

The drive wheels 680 and idler wheels 670 are mounted in a housing 612 secured to each end of frame 630. As in the preferred embodiment, a blow-out tube 666 is used as the axle for drive wheel 680. The drive wheel is connected to a drive gear 684, which meshes with and drives brush gear 644.

To adjust the depth of penetration of bristles 646 on brush 640, the idler roller 670 is mounted on an eccentric axle, 674. The axle 674 has a threaded stud 675 extending from its end off to one side of the axle's center. The stud a hole in the side of housing 612, and a lock nut 676 tightens on stud 675 to hold the axle 674. By rotating stud 675, the height that roller 670 holds the frame 630 and thus the brush 640 off of the blanket 6 may be adjusted.

The blow-out tube 666 extends to the edge of housing 612, where it aligns with a hole in piston 621 through which compressed air is supplied to blow-out the tube 652. The other end of blow-out tube 666 extends through a hole 656 formed in the cap end of tube 652. A cintered bronze bushing 657 provides a bearing surface between the blow-out tube 666 and the cap of tube 652.

In the embodiment shown, the frame 630 and housing 610 are made from machined pieces of 1" thick aluminum stock, bolted together with tie rods 634.

The housing 612 has locking pins 616 and 618 by which it is pinned to pistons 621 and 622. Pin 618 passes through a hole which is elliptical so that the housing can rotate about the pin 616 as the pistons 621 and 622 are actuated at different times.

In earlier embodiments of the invention, a brush 40 having uniformly spaced bristles was used. The uniformly packed brush worked in some applications. However, while cleaning some blanket cylinders, the brush became clogged with lint. In a later embodiment, a brush 40 was used which had a helically arranged row of bristles, with no bristles in between the helical rows. This embodiment did not work as well as the preferred embodiment because the lint seemed to escape from the cleaner due to the spaces between the helical dense packed bristles. It has been found that the brush 40 of the preferred embodiment discussed above is very effective in cleaning the blanket 6, and also the lint is flicked into the chamber 50. Thus the brush 40 of the preferred embodiment does not get clogged, but has a self-cleaning ability.

In earlier embodiments, a motor was used as the drive means for causing rotation of the cleaning brush. The motor was connected to the brush 40 by a drive belt, rather than gearing the brush 40 to a drive wheel 80. While this had the advantage of allowing rotation in any direction at any desired speed, it required the use of an additional piece of equipment and related wiring, which many press operators would disfavor.

During experiments with this motor driven embodiment, it was found that having the brush 40 rotate in a tangential direction opposite to the tangential rotation direction of the blanket cylinder 4 (as viewed at the place of contact between the cleaning brush and blanket cylinder and as shown in FIGS. 4 and 5) appeared to provide good cleaning with less smearing of the residual ink, and thus a higher quality printing operation while the cleaner is in operation.

In the preferred embodiment, the brush 40 tangential speed exceeds the blanket 6 tangential speed. Most preferably the speed of the brush 40 is 1.2 times the blanket speed.

It is preferred to rotate the brush in the opposite direction of blanket rotation. In some of the testing, rotation of the brush in the blanket travel direction but at a higher speed than the blanket produced angular marks extending from each character in the printing. The marks were at an angle approximately the same as the pitch angle of the helix of densely packed bristles 48. Reducing the speed so that it was the same as the blanket speed produced the same sort of marks, but not at a pitched angle. Cleaning by rotation in the reverse direction, especially at the preferred speed, penetration, bristle stiffness and bristle packing, has produced a very high quality image printed during the cleaning cycle.

In the preferred embodiment, pistons 90 are used to open the chamber 50. However, other actuation means are within the scope of the invention. If the rubber seal 54 provides sufficient sealing for the area 38 behind the shutter 52, it may be possible to do without cylinders 90 and just introduce compressed air to area 38, causing shutter 52 to rotate.

When cylinders 90 are used, it is preferred to have four cylinders for actuating the shutter on a standard size cleaner, which is used on a press with a blanket cylinder approximately 60 inches wide. For wider blanket cylinders, the number of pistons may need to be increased to six or more.

There are several advantages of the present invention, especially in its preferred embodiment. First, the system is capable of quick installation and removal. In fact, the only connections between the cleaner 10 and the cylinders 20 mounted on the press frame 2 are the locking pins 22. Thus, if a cleaner 10 needs to be serviced, the locking pins 22 are simply rotated and slid out of their holes in cartridges 360, and the entire cleaner 10 lifted clear of the press frame 2. A spare cleaner 10 can then be put into place using the already existing cylinders 20, which stay mounted on the press frame 2. There are no air or any other connections to be made in this type of a switch over, since the air for the shutter control enters the cleaner through holes 344 and 346 in the locking pins 22.

Another advantage of the brush 40 of the preferred embodiment is that it takes less torque to drive it than a brush with bristles densely packed across its entire surface. This makes it possible to drive the brush solely through power generated by frictional engagement of the drive roller 80 and bearer surface 7.

Since the system can clean at any time and does not effect print quality, the cleaning can be done more frequently than when a web splice occurs. Not only does this improve the quality of printing overall, it provides more consistent print quality and reduces blanket wear, since lint does not buildup on the blanket 6. Especially for older blankets, which are usually beat down in certain areas, allowing lint to build up and cause the printing to become grainy, more frequent cleaning will improve print quality, allowing a blanket to be used longer.

In addition to the benefits of the preferred brush 40 discussed above, another advantage is that the bristle spacing prevents lint from getting trapped between bristles. Where the bristles are not packed so closely together, they are able to flex further and thus better "flick" the lint into chamber 50.

With the delay period so that brush rotation begins before cleaning engagement, and the average low density of bristles 46, it is possible to drive the brush in a reverse rotation direction without using a motor. Thus, even though the bearer surfaces 7 are oily, frictional engagement between drive roller 80 and the bearer surface 7 is still sufficient to produce the reverse rotation cleaning motion produced in the preferred embodiment of the invention.

The simple mounting system of the cylinders 20 allows the cleaner 10 to engage the blanket cylinder 4 when the blanket cylinder 4 is in either its printing or "off" position (or even in its three color position for blanket cylinders so mounted). The only requirement is that the cylinder 20 be mounted, and the actuation piston 381 travel distance be sufficient so that the cleaner 10 can still be moved out of engagement when the blanket cylinder 4 is in its closest position, yet reaches the blanket 6 when the blanket cylinder 4 is in its furthest away position.

The lint collection system is simple, yet effective to remove lint from the blanket 6 and contain it so that it does not foul the working environment in the press room.

The preferred drive roller covering 85 is advantageous in that softer coverings result in a greater area of surface contact between the cover and the bearer surface 7. With oil on the bearer surface 7, this larger area of contact could produce less generated power due to a phenomenon equivalent to automobile tires hydroplaning on wet surfaces.

Since the brush 40 does not ride on the blanket 6, but is supported by the frame 30 which rides on the bearers 7, the brush 40 does not bump over the grooves in the blanket cylinder 4 containing the blanket ends. This results in less blanket wear, and prevents marks in the printing close to the blanket where such bumping action would otherwise cause uneven pressure and contact between the blanket 6 and the brush 40.

Of course, it should be understood that a wide range of changes and modifications can be made to the preferred embodiment in addition to those described above. For example, it may be possible to drive the brush 40 with only one drive roller 80, instead of one at each end, though this might produce undesired torquing in the cleaner. Also, more than one drive roller 80 could be used at each end to produce sufficient power to engage a brush in a reverse direction without starting to rotate the brush before it engages the blanket 7. Further, in less preferred embodiments the brush 40 could be mounted directly to the press frame, rather than in the frame 30, with the drive mechanism mounted to either the press frame or on a frame containing a lint chamber. It is therefore intended that the foregoing detailed description be regarded as illustrative rather than limiting, and that it be understood that it is the following claims, including all equivalents, which are intended to define the scope of this invention.

We claim:

1. An apparatus for removing lint from the surface of a blanket cylinder of a printing press comprising:

a) frame means spanning the width of the working surface of the blanket cylinder;

b) at least two drive rollers and two idler rollers, one of each being secured to each end of the frame means, said rollers being positioned to straddle the blanket and engage bearer surfaces of the blanket cylinder;

c) a cleaning brush rotatably mounted on the frame means;

d) drive means interconnecting said drive rollers and said cleaning brush to cause power developed by frictional engagement of the drive rollers and the bearer surface to cause rotation of the cleaning brush; and e) means for delaying a cleaning engagement of said cleaning brush with said blanket cylinder until after power generated by frictional engagement of the drive rollers with the bearer surface has been imparted to begin the rotation of the cleaning brush.

2. The apparatus of claim 1 wherein the idler rollers are mounted on piston means, and said means for delaying engagement comprises said piston means and a hydraulic circuit connected thereto.

3. The apparatus of claim 2 wherein said hydraulic circuit comprises a flow control valve through which hydraulic fluid flows from said piston means during the period when engagement is delayed.

4. The apparatus of claim 3 wherein said hydraulic circuit further comprises a reservoir into which hydraulic fluid flows during the delay period.

5. The apparatus of claim 4 wherein the hydraulic circuit further comprises return pressure means for forcing fluid from the reservoir after the apparatus is finished with a cleaning cycle, and a check valve allowing fluid to return from the reservoir to said piston means.

6. The apparatus of claim 5 wherein the check valve is in a flow path parallel to that of said flow control valve.

7. The apparatus of claim 5 wherein the reservoir comprises a hollow cylinder with a moveable piston sealingly disposed therein and wherein the return pressure means comprises a spring mounted so as to bias said piston toward the inlet end of said cylinder.

8. The apparatus of claim 1 wherein the drive means comprises gears interconnecting the drive rollers and the cleaning brush.

9. The apparatus of claim 2 wherein the drive means is functional to cause the cleaning brush to rotate in a tangential direction opposite to the tangential direction of rotation of a blanket cylinder, as viewed at the place of contact between the cleaning brush and blanket cylinder, frictionally engaged with said drive roller.

10. The apparatus of claim 1 further comprising a lint collecting means.

11. The apparatus of claim 10 wherein the lint collecting means comprises a normally closed chamber and opening actuation means to open said chamber during frictional engagement between the drive rollers and the bearer surface.

12. The apparatus of claim 11 wherein said chamber is connectable to a source of compressed air.

13. The apparatus of claim 12 wherein said chamber further comprises a rotatable brush means for dislodging lint particles from the inside surfaces of the chamber.

14. The apparatus of claim 13 wherein the rotatable brush means is driven by an air-powered turbine.

15. The apparatus of claim 11 wherein the opening actuation means comprises one or more pneumatic cylinders mounted to the frame means and the chamber.

16. The apparatus of claim 11 wherein the chamber comprises a longitudinal element having a generally U-shaped cross section and longitudinal sealing lips mounted on both longitudinal extremities of the U-shaped longitudinal element, the sealing lips cooperating with the frame means to seal the chamber while in its closed position so that compressed air introduced at one end of the chamber will blow through the chamber and carry lint out the other end of the chamber.

17. The apparatus of claim 1 further comprising mounting means for mounting the frame means to the frame of a press, the mounting means including means for forcing said drive rollers into frictional engagement with the bearer surface of a blanket cylinder mounted on the press frame.

18. The apparatus of claim 17 wherein the forcing means is capable of causing frictional engagement between the drive rollers and the bearer surface of the blanket cylinder when the blanket cylinder is positioned in any of its normal operating or intermediate positions on the press frame.

19. The apparatus of claim 17 wherein:

a) the forcing means comprises two pneumatic cylinders, one of each being connected to each end of the frame means; and b) actuation of the pneumatic cylinders causes simultaneous engagement of all four of the rollers with the bearer surface.

20. The apparatus of claim 19 wherein the means for delaying cleaning engagement comprises:

a) a hydraulic circuit comprising piston means mounted behind each of the idler rollers, a needle valve and an accumulator reservoir; and b) wherein pressure exerted by the pneumatic cylinders and opposed by the bearer surface causes the idler rollers to exert pressure on the piston means sufficient to cause hydraulic fluid to flow through the needle valve and into the reservoir.

21. The apparatus of claim 20 wherein the distance that the idler rollers may travel in forcing said piston means is mechanically limited, said limit also providing a stop position to limit the proximity of the cleaning brush to the blanket cylinder.

22. The apparatus of claim 1 wherein said cleaning brush has a longitudinal cross section of differentially spaced bristle elements, such that in a plurality of areas the bristle elements are densely packed, and in the spaces between the plurality of densely packed bristles, the bristles are sparsely placed, and ii) said densely packed areas are offset circumferentially such that during rotation of the cleaning brush while said apparatus is in a cleaning position, each area of the blanket is sequentially contacted by densely packed and sparsely placed bristles.

23. The apparatus of claim 22 wherein the densely packed bristles are arranged in a helical pattern on the cleaning brush.

24. The apparatus of claim 22 wherein the ratio of bristles per unit of brush surface area between the densely packed and sparsely placed areas is between about 2:1 and about 5:1.

25. The apparatus of claim 22 wherein the ratio of bristles per unit of brush surface area between the densely packed and sparsely placed areas is about 17:5.

26. The apparatus of claim 22 wherein the drive means is frictional to drive said cleaning brush in a tangential direction opposite to the tangential direction of the blanket when the apparatus is in a cleaning position.

27. The apparatus of claim 26 wherein the drive means is sufficient to cause the cleaning brush to rotate at a tangential speed in excess of the tangential speed of the blanket when the apparatus is in a cleaning position.

28. The apparatus of claim 1 wherein the means for delaying cleaning engagement is effective to delay said engagement until the cleaning brush reaches its normal cleaning speed.

29. The apparatus of claim 1 wherein the means for delaying cleaning engagement is effective to delay said cleaning engagement for a period of about 3 seconds or more.

30. An apparatus for removing lint from the surface of a blanket cylinder of a printing press comprising:

a) frame means spanning the width of the working surface of the blanket cylinder;

b) a plurality of rollers, at least one of which is secured to each end of the frame means, said rollers being positioned to straddle the blanket and engage bearer surfaces of the blanket cylinder, at least one of said rollers being a drive roller;

c) a cleaning brush rotatably mounted on the frame means;

d) drive means interconnecting said drive roller and said cleaning brush to cause power developed by frictional engagement of the drive roller and the bearer surface to cause rotation of the cleaning brush;

e) means for delaying a cleaning engagement of said cleaning brush with said blanket cylinder until after power generated by frictional engagement of the drive roller with the bearer surface has been imparted to begin the rotation of the cleaning brush; and f) a lint collector comprising a normally closed chamber and opening actuation means to open said chamber during frictional engagement between the drive roller and the bearer surface.

31. The apparatus of claim 30 wherein said chamber is connectable to a source of compressed air.

32. The apparatus of claim 31 wherein said chamber further comprises a rotatable brush means for dislodging lint particles from the inside surfaces of the chamber.

33. The apparatus of claim 32 wherein the rotatable brush means is driven by an air-powered turbine.

34. The apparatus of claim 30 wherein the opening actuation means comprises one or more pneumatic cylinders mounted to the frame means and the chamber.

35. The apparatus of claim 30 wherein the chamber comprises a longitudinal element having a generally U-shaped cross section and longitudinal sealing lips mounted on both longitudinal extremities of the U-shaped longitudinal element, the sealing lips cooperating with the frame means to seal the chamber while in its closed position so that compressed air introduced at one end of the chamber will blow through the chamber and carry lint out the other end of the chamber.

* * * * *